US005836423A

United States Patent [19]

Kunczynski

[11] Patent Number: 5,836,423

[45] Date of Patent: Nov. 17, 1998

[54] PEOPLE MOVER SYSTEM

[76] Inventor: Jan K. Kunczynski, 1862 Jan Dr., Glenbrook, Nev. 89413

[21] Appl. No.: 742,653

[22] Filed: Nov. 4, 1996

[51] Int. Cl.[6] ..... B66B 9/06

[52] U.S. Cl. ..... 187/245; 187/255

[58] Field of Search ..... 187/295, 200, 187/201, 240, 244, 406, 255; 212/291; 182/141

[56] References Cited

U.S. PATENT DOCUMENTS 4,821,845 4/1989 DeViaris ..... 187/245

FOREIGN PATENT DOCUMENTS 402276787 11/1990 Japan ..... 187/245

*Primary Examiner*—Kenneth Noland
*Attorney, Agent, or Firm*—Flehr Hohbach Test Albritton & Herbert LLP

[57] ABSTRACT

A people mover system (110) comprising an elevated track (112) having a horizontal section (114) and vertical end sections (116, 118) and a passenger car (124) movably carried on track (112). Horizontal track section (114) is elevated above an intersection or roadway (140) a height sufficient to permit vehicular traffic to pass beneath car (124). A drive mechanism is provided extending along track (124) for propelling the passenger car in both vertical and horizontal directions between a first load/unload point (120) and a second load/unload point (122).

100 Claims, 17 Drawing Sheets

PEOPLE MOVER SYSTEM

TECHNICAL FIELD

The present invention pertains to people mover systems, and more particularly, to elevated or tunneled people mover systems designed to carry passengers across roads, railroad tracks, waterways, or any type of area where pedestrian traffic is undesirable or is to be limited.

BACKGROUND ART

In order to provide a safe and efficient pedestrian crossing through vehicular traffic, it is desirable to separate the pedestrian traffic from the vehicular traffic. This is usually accomplished by separating vertically the planes of crossing for pedestrians and vehicles. A typical example is an elevated pedestrian cross walk or tunneled underpass.

Provision of separate vehicular and pedestrian passes is especially important at busy intersections, where otherwise people and vehicles would wait to get past each other. For example, some intersections along Las Vegas Boulevard in Las Vegas, Nev. are so congested with pedestrian and vehicular traffic that large numbers of people amass at each intersection corner, waiting several minutes to cross many lanes of vehicular traffic. While pedestrians cross, vehicles wait, and visa versa. During peak season in Las Vegas, and especially at night, the congestion is at its worse.

Several solutions to this problem have been proposed. One solution has been to build elevated cross walks over each street of the intersection. Another proposed solution is to build subterranean or tunneled cross walks. Both of these types of cross walks require the installation of stairs, escalators, and vertical or inclined elevators at each intersection to handle the pedestrian traffic, with the required change in elevation being in the range of 24–30 feet.

Elevated cross walks, like escalators and elevators, can be generally expensive structures to build. Pedestrian overpasses must be constructed to high load requirements, typically 150 lbs. per square foot over their entire surface area. For wide overpasses, the overpass support structure may have to be designed to carry live load 2000 lbs. per linear foot, which imposes large dimensions on the structures. Large structures greatly increase the cost of seismic reinforcement.

The total required "foot and skyprint" of crosswalks and their associated machinery (stairs, elevators, escalators, inclined elevators) may be larger than desired or not even practical where space is at a premium. This is particularly true for escalators and inclined elevators, which for their vertical rise require a significant amount of space.

Tunneled crosswalks have their own particular drawbacks. Tunneled crosswalks can create problems with relocating or avoiding utility lines. In addition, tunnel construction may impair traffic flow for an extended period of time. The issue of public safety is also highlighted with a tunnel structure. Such closed structures often need surveillance, in order to prevent or discourage crime. Furthermore, the cost of maintenance, heating, ventilating, lighting, and flooding control is also significant.

Another problem with cross walks, either elevated or tunneled, is that for some large intersections, long walking distances are imposed, which can be tiresome and slow for some people to cross.

Cable driven systems are also employed to transport large numbers of passengers. Examples of such systems are aerial tramways and funiculars. With such systems, a relatively thick cable is entrained around a large bull wheel to achieve the significant driving forces necessary to raise and propel a passenger car. The support structure and housing for a bull wheel usually is a sizeable structure. In addition, known cable driven systems require a lengthy approach to raise and lower their passenger cars to load/unload stations. The requirement of a lengthy approach and sizeable bull wheel structure make cable driven systems impractical for many installations where space is at a premium.

It is an object of the present invention to provide quick and efficient system for handling pedestrian traffic in areas where pedestrian traffic is to be limited or prohibited.

It is another object of the present invention to provide a compact people mover system that can be installed with a relatively small foot and skyprint.

DISCLOSURE OF INVENTION

Briefly described, a first embodiment of the present invention comprises a people mover system for transporting persons from a first load/unload point to a second load/unload point. The people mover system includes a guideway extending along a transit path between the two load/unload points. The system also includes a drive assembly that has a traction belt extending along the guideway and distributed drive elements for applying a drive force to the traction belt over a portion of the length of the guideway. A passenger car and an attachment assembly are provided, the attachment assembly securing the passenger car to the traction belt for propulsion of the passenger car along the guideway by the traction belt. The guideway has a near vertical section formed for guided substantially vertical movement of the passenger car to a vertical position permitting horizontal movement of the passenger car. The guideway also has a horizontally extending section of substantial length relative to the vertical section to allow the passenger car to accelerate to a speed substantially greater than walking speed. The guideway is formed for continuous guided movement of the passenger car between the vertical section and the horizontally extending section. The attachment assembly is formed to permit the passenger car to remain in a relatively level orientation as the passenger car is propelled along the guideway.

The combination of a guideway having a vertical and a horizontally extending section with a distributed drive system applying driving forces to a traction belt along the guideway achieves substantial drive forces with a relatively compact system. The vertical and horizontally extending sections allow the passenger car to rise over, or move below, obstacles proximate to the system, such as roadways. The compact guideway and distributed drive mechanism greatly reduce the foot and skyprint of the system, which allows the system to be installed in many areas where space is limited.

According to an aspect of the invention, the distributed drive elements include a multiplicity of drive components distributed along a substantial length of the guideway. Preferably, the vertical section and the horizontally extending section are joined along a convex path relative to the two load/unload points, and the distributed drive elements are distributed along the convex path. The distributed drive elements include a multiplicity of drive sheaves, which are positioned along the convex path at locations where the traction belt deflects to at least a small degree over a portion of the circumference of the sheaves.

According to another aspect of the invention, the traction belt is entrained around return sheaves approximate the two load/unload points. At a location between the two load/ unload points the guideway forms a convex path along which the traction belt moves, and the distributed drive elements are positioned along the convex path. The drive sheaves are positioned along the convex path in a manner where the traction belt deflects to at least a small degree over a portion of the circumference of the sheaves. This significantly enhances the driving engagement between the traction belt and the drive sheaves, allowing the system to achieve substantial drive forces, yet also allowing for a reduction in size in the drive mechanism.

According to another aspect of the invention, the guideway includes an additional vertical section formed for movement of the passenger car to a vertical position permitting horizontal movement of the passenger car. The additional vertical section is connected to the horizontally extending section in a manner permitting continuous guided movement of the passenger car between the additional vertical section and the horizontally extending section. With continuous guided movement, the passenger car experiences a smooth ride between the load/unload points.

According to another aspect of the invention, the guideway has a generally convex longitudinal side elevation profile with the first near vertical section positioned proximate one load/unload point and the second near vertical section is positioned proximate the second load/unload point and the horizontally extending section spans between the load/unload points. With near vertical sections, the people mover system can be used to transport passengers over roadways with a system that does not occupy a substantial area adjacent the roadway. Specifically, the guideway extends transversely over the roadway with one of the load/unload points positioned on one side of and proximate to the roadway and another of the load/unload points positioned on an opposite side of and proximate to the roadway. The guideway includes two vertical sections each formed for near vertical movement of the passenger car to an elevation allowing the passenger car to pass over vehicles on the roadway, and the guideway further includes two transition sections connecting the vertical sections to opposite ends of the horizontally extending section for smooth continuous movement of the passenger car between the vertical sections and the horizontally extending section.

According to another aspect of the invention, a pair of return sheaves are provided at each end of the track, and the drive belt is entrained around the return sheaves. Preferably, one of the return sheaves includes a tensioning device for maintaining tension in the drive belt. By distributing the drive elements along the guideway, it is possible to use return sheaves that are relatively small in diameter, which decreases the foot print of the system.

According to another aspect of the invention, the drive mechanism includes a plurality of drive sheaves aligned along curved sections of the track provided between the vertical and horizontal track sections. A plurality of drive sheaves are provided along both an upper run and a lower run of the drive belt. The drive sheaves are located at curved sections of the track to enhance the driving engagement between the sheaves and the belt.

According to another embodiment of the present invention, the people mover system comprises a system for transporting persons from a first point to a second point. The system comprises an elevated or below ground track extending from the first point to the second point. A carriage is movably carried by the track, and a passenger car carried by the carriage. A drive mechanism is provided for moving the carriage between the first and second points. A lift mechanism movable with the carriage is provided for raising and lowering the passenger car between an elevated position and a surface level position. Persons load into and unload from the passenger car when the car is at a surface level position at the first point, and then are transported to the second point by first raising or lowering the passenger car, then moving the passenger car across to the second point, and then lowering or raising the passenger car.

According to an aspect of the invention, the lift mechanism includes a winch and belt mechanism, including a plurality of belts extending between the winch and the passenger car. Each of the plurality of belts includes a width dimension that is substantially greater than a depth dimension of the belt, and the belts are align so that their width dimension aligns with the direction of movement of the passenger car. In this manner, inertia of the passenger car during acceleration and deceleration is overcome by the belts carrying load forces along the width dimension of the belts.

According to another aspect of the invention, the drive mechanism includes a drive ring extending around the track. The carriage is coupled to the drive ring, and a plurality of drive rollers driving engaging the drive ring to propel the ring and the carriage along the track. Preferably, the drive rollers include pairs of opposed pinch rollers biased against the drive ring on opposite side thereof.

In one form of this embodiment of the invention, an elevated people mover is designed for carrying people between corners of a street intersection, in a manner permitting vehicle traffic to proceed through the intersection unimpeded by pedestrian traffic. The elevated street crossing people mover comprises an elevated closed loop track extending around the intersection and above a surface level load/unload point at each intersection corner. A car is provided for each intersection corner. Each car is carried and guided by the elevated track and each car has sufficient room to load a multiplicity of persons.

A drive ring extends along the track, and each car is coupled to the drive ring at spaced intervals along the ring corresponding to the distance between intersection corners. A drive mechanism is provided on the elevated track for propelling the drive ring around the track, and hence propelling the car around the track between intersection corner. Each car has associated with it a lift mechanism adapted to travel with each car for raising and lowering the car between an elevated position and a surface level position. In operation, each car is lowered by the lift mechanism at each intersection corner to load and unload passengers, then raised to an elevated position, then conveyed to the next intersection corner, then lowered at the next intersection corner to load and unload people, and so on, in a manner allowing a person to get from any of the intersection corners to any of the other intersection corners without having to cross through vehicle traffic.

According to another aspect of this embodiment of the invention, the pacing between cars is uniform, so that as each car travels around the track and stops at the next intersection corner the other cars are each positioned over an intersection corner, in position to be lowered to a load/unload point.

The present invention also comprises a method of moving a passenger car between two load/unload points, including the steps of guiding the passenger car along a guideway extending between the two load/unload points. The guideway has a near vertical section formed for guided substantial vertical movement of the passenger car to a vertical position permitting horizontal movement of the passenger car. The guideway also has a horizontally extending section of substantial length relative to the vertical section. Further, the guideway is formed for continuous guided movement of the passenger car between the vertical section and the horizontal section. The method further includes the steps of driving the passenger car along the guideway by means of a traction belt extending along the guideway by drivingly engaging the traction belt with a plurality of distributed drive elements, to propel the traction belt and the passenger car along the guideway. The method also includes the step of leveling the passenger car as it travels along the guideway.

According to another aspect of the method, the traction belt is tensioned by entraining the traction belt around a pair of return sheaves, and the traction belt is adjustably tensioned by adjusting the position of one of the return sheaves.

Preferably, the step of driving the passenger car includes accelerating the passenger car along the horizontally extending section to a speed substantially in excess of walking speed.

According to another aspect of the method, the step of guiding the passenger car includes moving the passenger car a vertical distance sufficient to permit horizontal movement of the passenger car. The passenger car moves a vertical distance sufficient to avoid obstacles to horizontal movement of the passenger car. Preferably, the passenger car moves a vertical distance at least as great as the height of the passenger car.

According to another aspect of the method, the guideway includes a second near vertical section spaced from the first-named near vertical section, so that the passenger car is propelled along a first vertical distance, then is propelled in a horizontally extending direction, and then is propelled in a second vertical distance, as the passenger car moves between the two load/unload points.

According to the method, the guideway is positioned proximate a vehicle roadway, and the near vertical sections are positioned proximate opposite sides of the roadway, and the passenger car is loaded and unloaded at a first load/unload point adjacent one side of the roadway, then is carried over the roadway to a second load/unload point.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWING

Throughout the several views, like reference numerals refer to like parts, wherein.

BEST MODE OF CARRYING OUT THE INVENTION

The present invention provides an effective people mover system that combines horizontal and vertical movement of a passenger car with a compact and efficient drive mechanism that in combination with a passenger car guideway provides a high volume people mover system with a relatively small foot and skyprint. The proposed system is capable of moving people at speeds comparable to modern elevators and horizontal people mover systems, accelerating in excess of 2 $ft/s^2$ and reaching speeds three to five times faster than walking. The present invention combines horizontal and vertical movements in a manner particularly suitable for transporting persons across areas where pedestrian traffic is undesirable or is to be limited, such as busy intersections, roadways, railroad tracks and waterways, etc. The system of the present invention is to be used by the public in much the same way as conventional cross walks having escalators, elevators and travelators or movable walkways.

Two basic systems are proposed. In the first system, shown in FIGS. 1–10, a passenger car travels vertically and horizontally in a single vertical plane shuttle system. In the second system, shown in FIGS. 11–19, a passenger car travels in two planes, a horizontal plane for forward movement in a closed loop around and across a non-pedestrian area and a vertical plane for movement to and from a load/unload station.

Single Vertical Plane System

Figure 1:
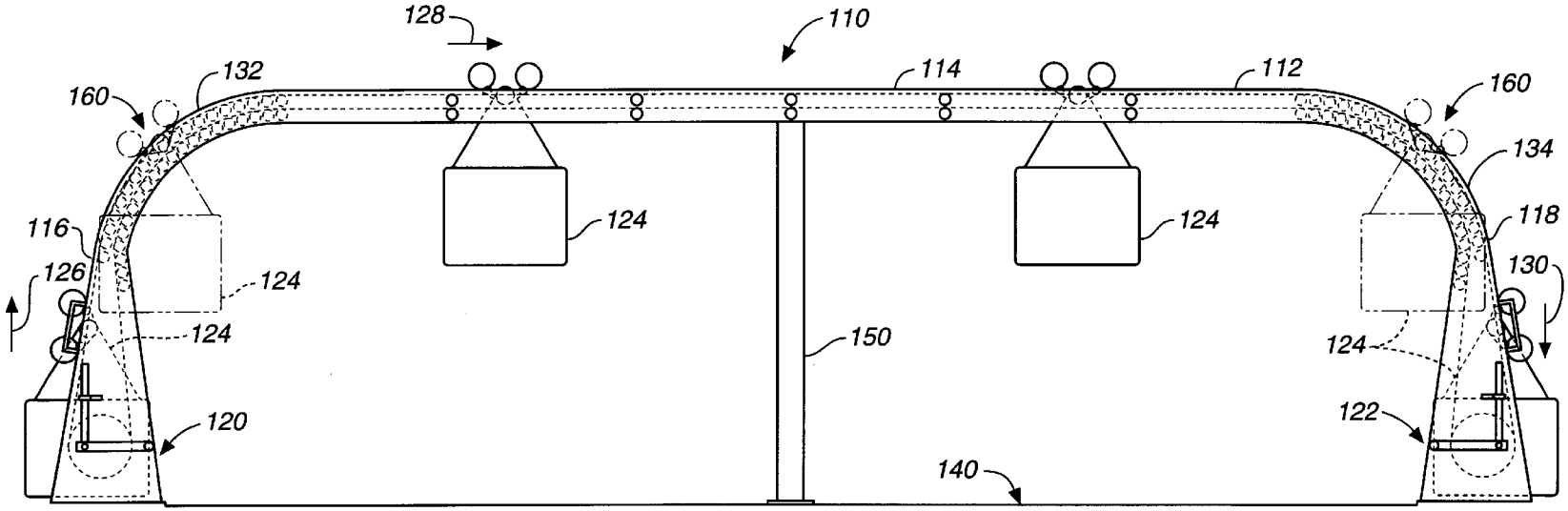
FIG. 1 is a schematic side elevation view of a shuttle embodiment of the people mover system of the present invention.
Figure 2:
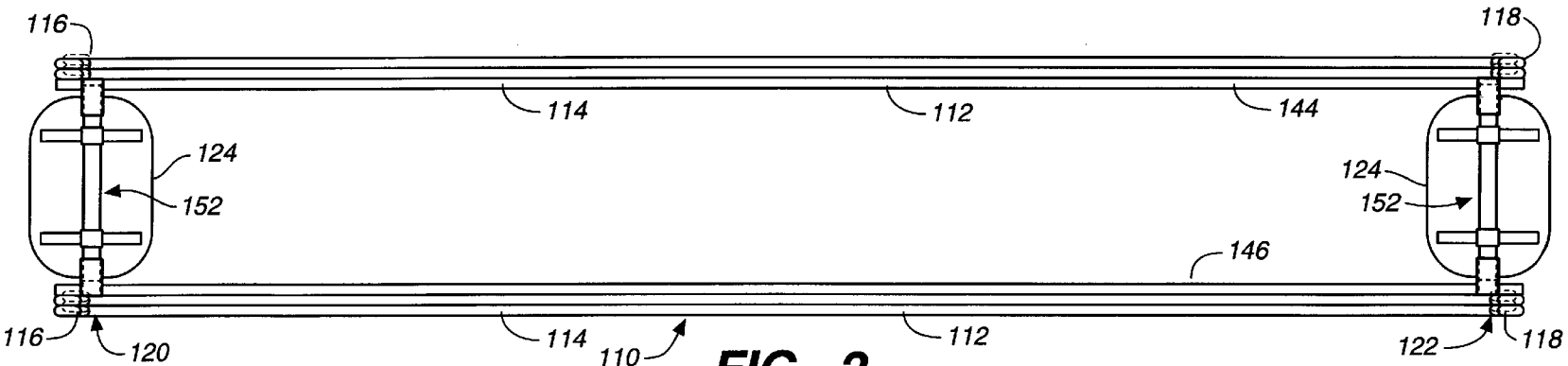
FIG. 2 is a plan view of the shuttle system of FIG. 1, shown with only two passenger cars.

FIGS. 1–10 disclose a first embodiment for a people mover shuttle system 110 of the present invention. Referring to FIGS. 1 and 2, shuttle system 110 includes an elevated arched track structure 112 having a horizontal section 114, a first vertical section 116 and a second vertical section 118. Elevated track structure 112 also includes curved sections 132, 134. First vertical section 116 is associated with a first load/unload point 120 and second vertical section 118 is associated with a second load/unload point 122. A passenger car 124 is transported by a drive assembly discussed herein between first point 120 and second point 122 along track structure 112. Six passenger cars 124 are illustrated in the figure to show the position of the car at various points along track structure 112. The system actually uses only one passenger car per track.

In the disclosed embodiment, track 112 forms an inverted U-shape, with two curved sections 132, 134. It can be said that track 112 is downwardly convex. However, it is possible to configure the shuttle system with a single curved track section wherein the track rises or descends from a first load/unload point and then curves and extends in a horizontal direction to a second load/unload point. An L-shaped track would form just such a system, which could be used when the load/unload points are at different elevations.

Passenger car 124 is transported along a transit path first vertically upwardly from first load/unload point 120 in the direction of arrow 126, then horizontally in the direction of arrow 128 and finally vertically downwardly in the direction of arrow 130 to second load/unload point 122. Vertical sections 116, 118 do not have to be precisely vertical and, in fact, it has been found that a slight inward slope of approximately 80 degrees for sections 116, 118 can be advantageous to provide gravity assisted guidance and to create a weight load of the passenger car against the track to offset wind loads. However, sections 116, 118 will be referred to herein as being vertical, near vertical, or substantially vertical, and it should be understood that these sections may have a slight inward slope.

It is important that sections 116, 118 be formed for guided substantially vertical movement of the passenger car to a vertical position permitting horizontal movement of the car. By this, it is meant that the passenger car is either raised or lowered (for a tunnel system) vertically to a point where the car can pass over or under obstacles across the car's transit path. For example, with the system installed over a roadway, the passenger car is raised to a vertical height permitting horizontal movement of the passenger car over vehicles using the roadway.

As passenger car 124 moves around curved sections 132, 134, the car self-aligns itself as does a conventional aerial tramway. Preferably, this is accomplished by pivotally carrying the passenger car on a carriage assembly that rolls along track structure 112. As the passenger car transitions along track sections 132, 134, the car orients itself so that the floor of the cabin is substantially horizontal. The pivot mechanism and carriage are discussed in more detail with reference to FIGS. 6 and 7.

As passenger car 124 transitions between vertical sections 116, 118 to horizontal section 114, and through curved transition sections 132, 134, the track provides continuous guidance for the passenger car. The drive components, discussed later, are located at the curved transition sections. With the track structure providing continuous guidance for the passenger car as the car transitions through section 132, 134, the passenger car does not experience uncomfortable bumps as the car passes over the drive components.

In the embodiment shown in FIG. 1, system 110 is shown installed over a multi-laned street or highway 140. With this application, passenger car 124 is carried at a level where the bottom edge of passenger car 124 is raised to a height sufficient to move over vehicular traffic on roadway 140, which height may be approximately 18 ft. Street 140 is approximately 120 ft. across. For the passenger car size and load capacity discussed herein, elevated track structure 144 is supported by a middle tower 150. The provision and spacing of towers 150 is dictated by the span and design of track 112, as well as the layout of the intersection or other area over which system 110 is built. A larger number of towers may be used or larger cross-section beams may be used for track 112 for longer spans.

The idea of system 110 is to provide a short, compact, high capacity people mover system capable of carrying high volumes of pedestrian traffic across street 140 in a manner permitting vehicular traffic to use the roadway below unimpeded by pedestrian traffic. However, the system of FIG. 1 is suitable for use in other applications, such as transporting pedestrians over railroad tracks, waterways, buildings, or any other type of area where pedestrian traffic is undesirable or is to be limited. It should be noted that the present invention does not preclude the allowance of pedestrian traffic across the area between the load and unload points of the system.

As shown in FIG. 2, elevated track 112 of system 110 is shown to include a pair of mirror image track sections 144, 146, one on each side of passenger car 124. While the shuttle system discussed herein is shown to include a rigid track, other types of guideways can be used that provide a means for guiding the passenger car along a transit path between the load/unload points. As discussed in more detail herein, passenger car 124 is supported between track sections 144, 146. In FIG. 2, a passenger car 124 is shown at each load/unload point 120, 122 merely to illustrate the cars positions at these points. The actual system only includes one passenger car.

Figure 3:
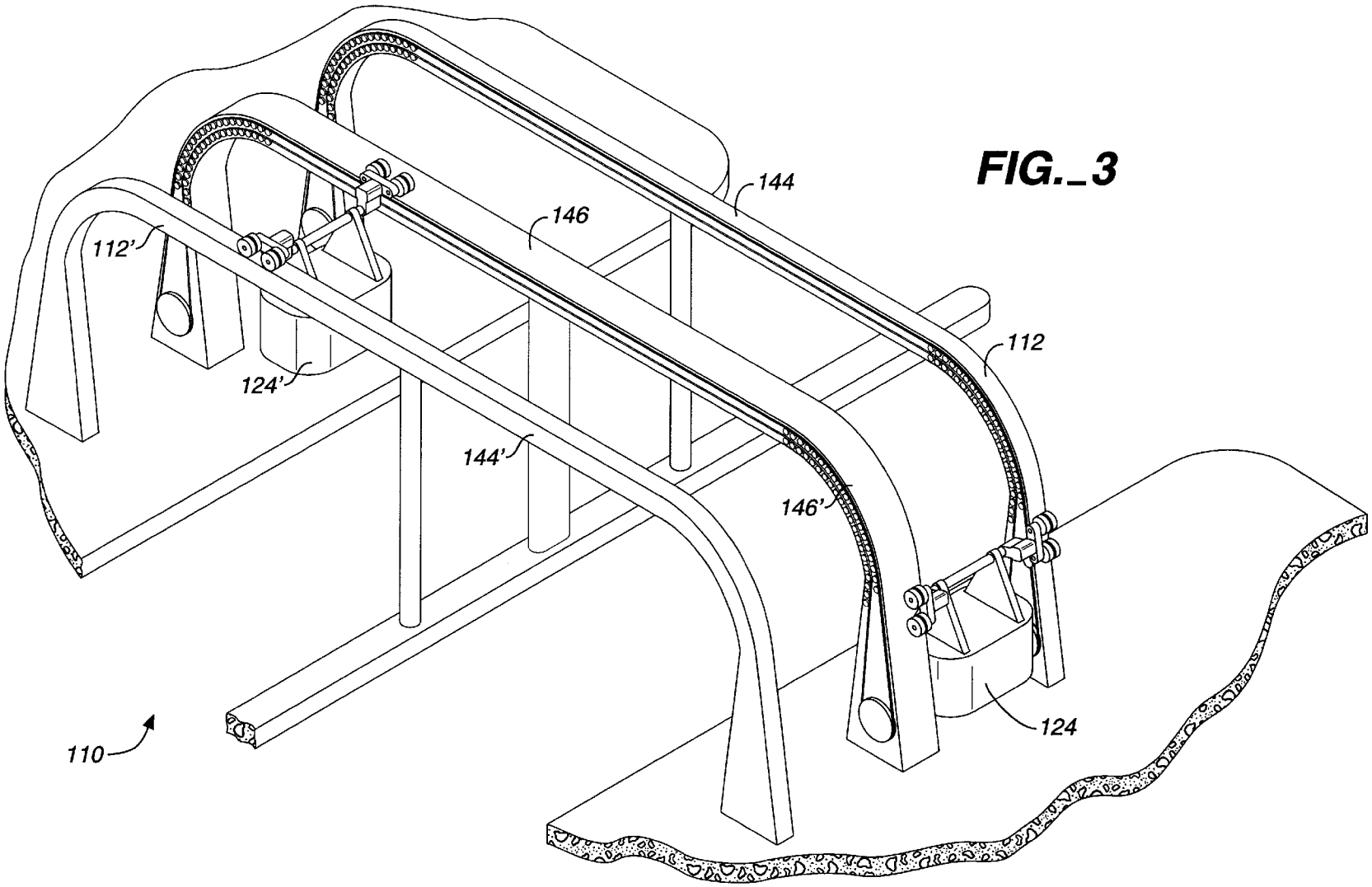
FIG. 3 is a computer generated image of a parallel track arrangement of the people mover system of FIG. 1.

In FIG. 3, a second, parallel elevated track system 112' is shown adjacent track 112. Parallel track 112' is identical to track 112 and can be provided as part of the system where it is desirable to have more than one passenger car to handle the load of pedestrian traffic. With the parallel track system, passenger car 124 is positioned at one side of the intersection, while another passenger car 124' is positioned at the other intersection corner. In this manner, pedestrian traffic moves quickly across street 140. The drive systems and associated controls for tracks 112, 112' are independent of one another. However, the adjacent track structures 146 and 146' of each parallel track can share common structural components, as shown in the figure.

Figure 4:
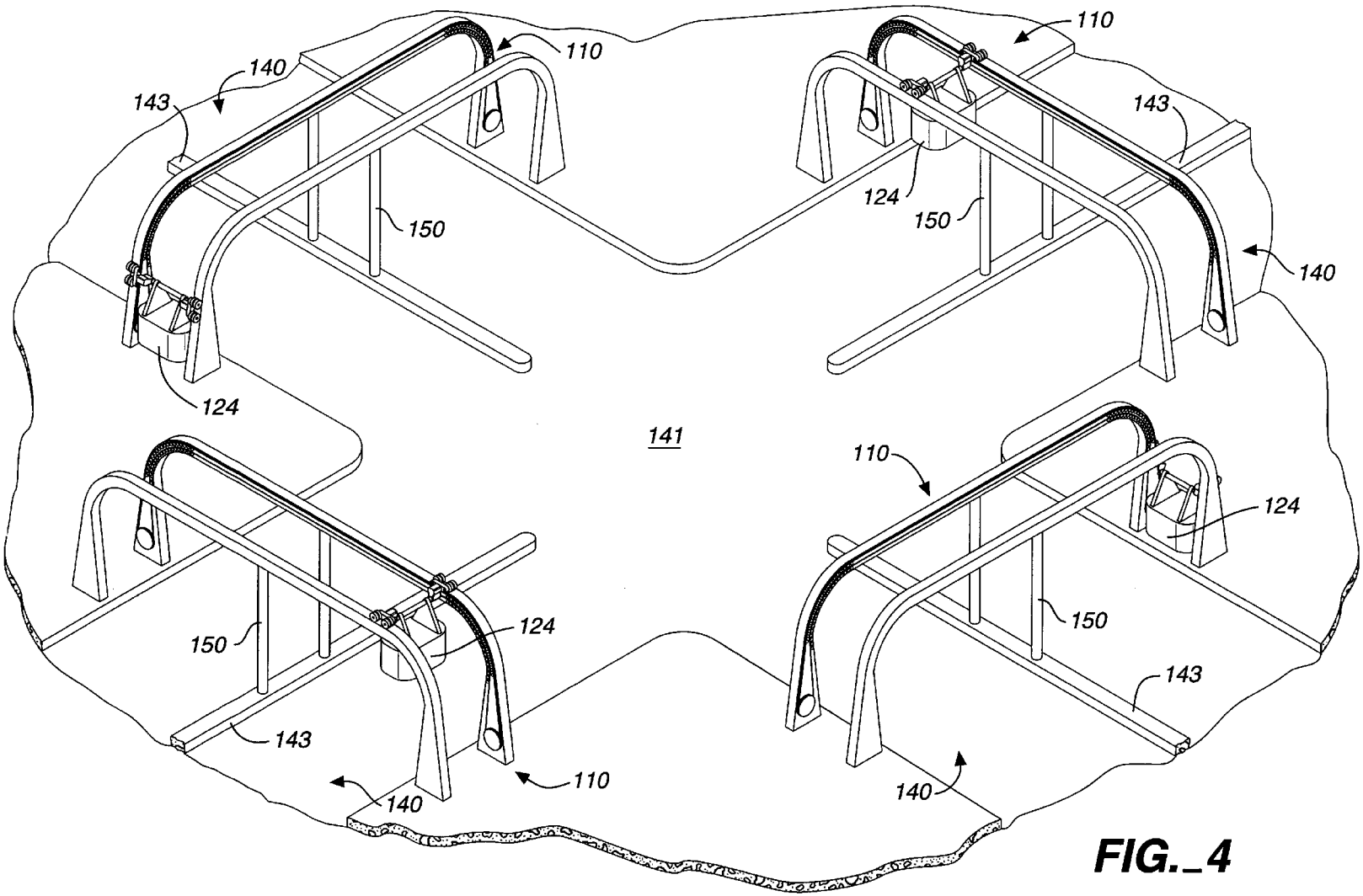
FIG. 4 is a schematic pictorial view of the shuttle system of FIG. 1, shown installed across each street of an intersection.

FIG. 4 is a schematic pictorial view of shuttle system 110 installed at a conventional four-way intersection 141. Roadways 140 are multi-laned streets having medians 143 providing anchor points for track support towers 150. Depending on the level of pedestrian traffic, passenger cars 124 can be controlled to operate on schedule or on demand. While the present invention is not meant to be limited to a particular type of crossing, the present invention is particularly useful for providing pedestrian crossing of busy roadways and intersections, especially multi-laned roads.

Figure 5:
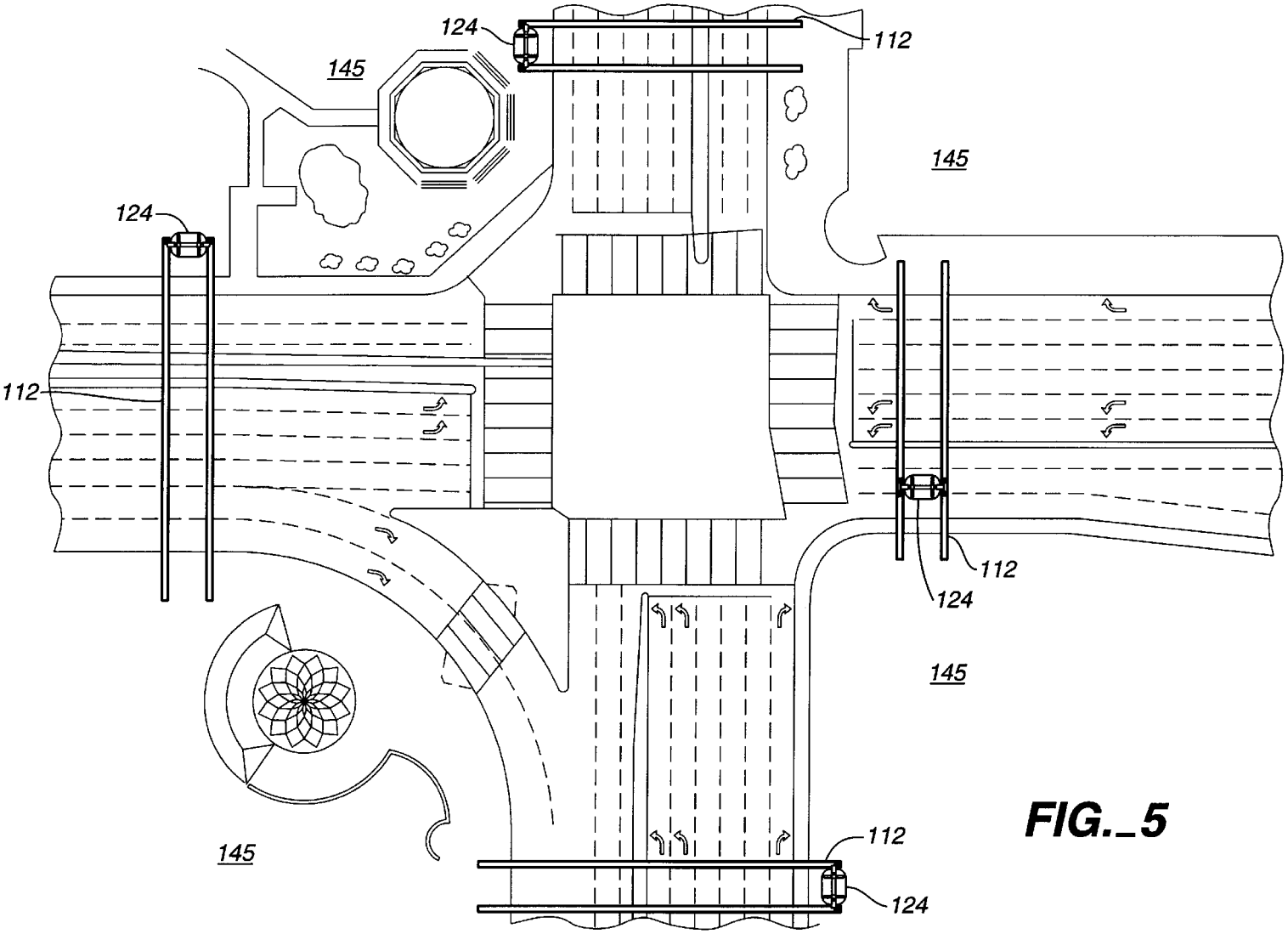
FIG. 5 is a schematic plan view of the shuttle system of FIG. 4, shown installed at the intersection of Las Vegas Boulevard and Flamingo Boulevard in Las Vegas, Nev., USA.

FIG. 5 is a schematic plan view of the shuttle system of FIG. 4 shown installed at the intersection of Las Vegas Boulevard and Flamingo Boulevard in Las Vegas, Nev., USA. This particular intersection exemplifies the advantages that can be achieved with the compact, high capacity people mover system of the present invention. A shuttle track assembly 112 is installed over adjacent intersection corner 145, each spanning many lanes of traffic. Each track assembly 112 has a relatively small "footprint" and can be positioned in close proximity to the existing sidewalks and pedestrian paths that run adjacent the two boulevards. Close proximity to the adjacent roadways is achieved due to the provision of a vertical track section adjacent a load/unload point. For the system shown in FIG. 5, passenger car crossing times are approximately 30 seconds and each car has a nominal capacity of approximately 110 passengers. This produces a high capacity system capable of transporting large numbers of persons across the intersection.

Figure 6:
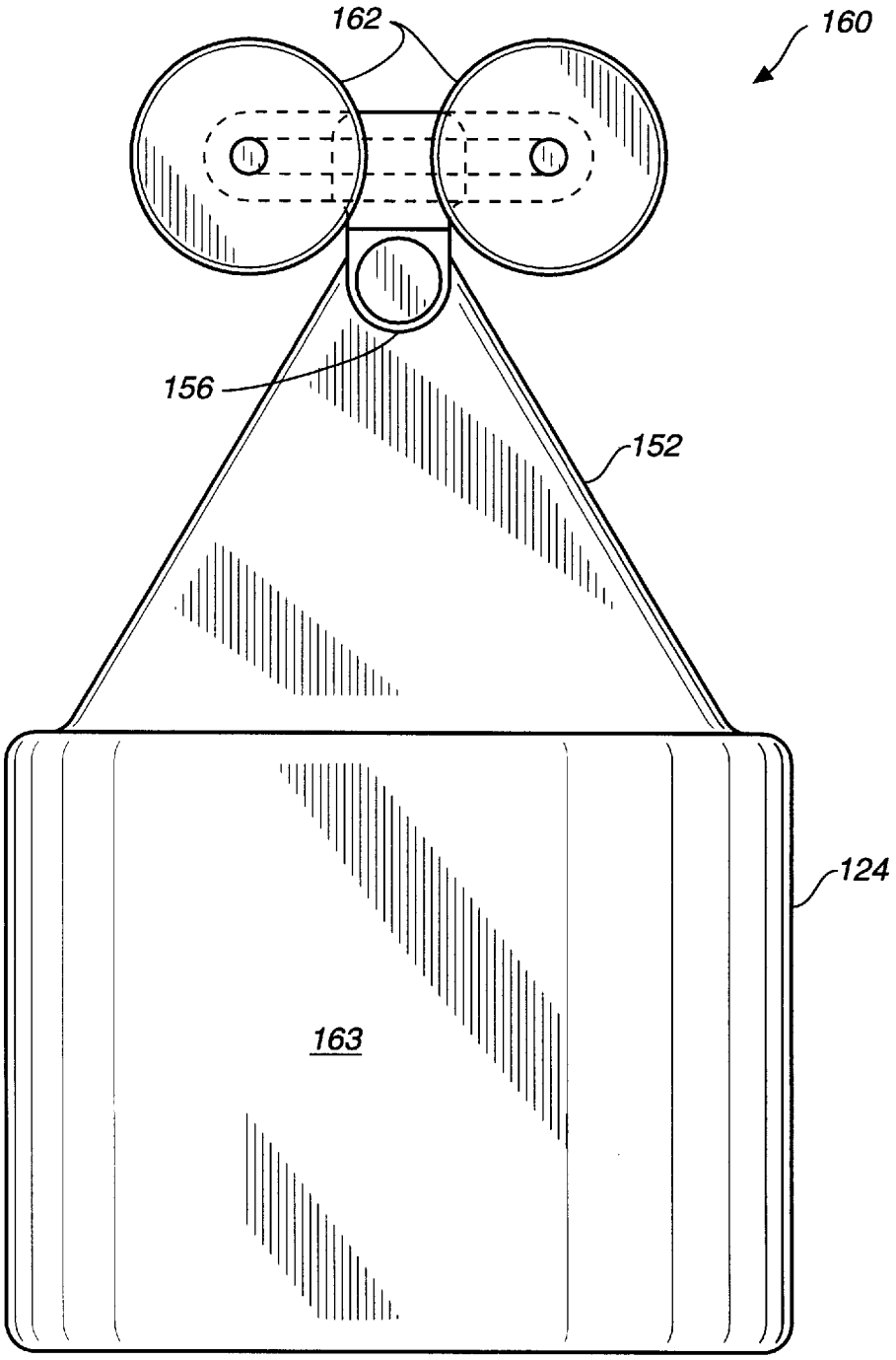
FIG. 6 is an enlarged schematic side view showing the hanger assembly and carriage assembly for carrying a passenger car of the system of FIG. 1.

Referring to FIG. 6, passenger car 124 is suspended by a hanger apparatus 152 that attaches to a center axle beam 156. Axle beam 156 is pivotally carried by a carriage assembly 160, which rides along the upper edge (or outer edge) of the track structure. Carriage assembly 160 includes a set of four rollers or wheels 162 that roll along the upper surface of the track structure. Carriage assembly 160 is discussed in more detail with reference to FIG. 8. Passenger car 124 is approximately 140 inches wide by 180 inches long by 10 ft. in height. Sliding doors 163 are provided at both the front and back of the cabin of the car. Carriage assembly 160, axle beam 156 and hanger apparatus 152 can be said to form an attachment assembly that permits the passenger car to remain in a level orientation as the car moves from a vertical track section to the horizontal track section.

Figure 7:
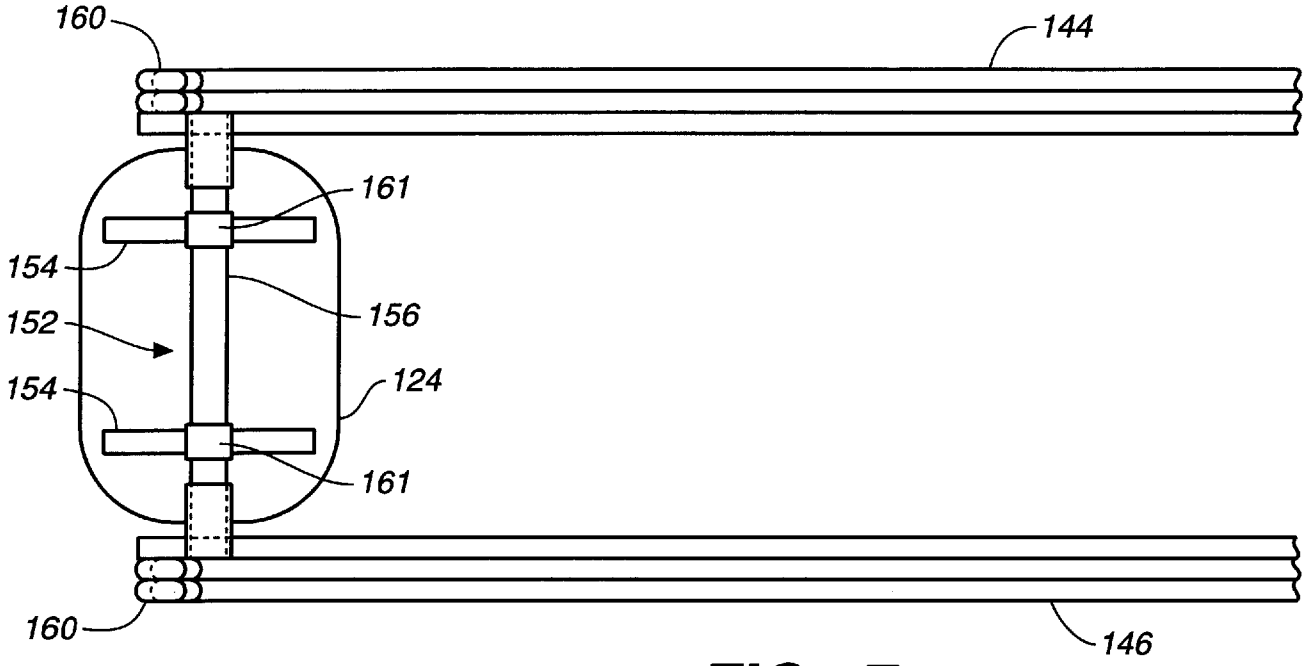
FIG. 7 is an enlarged schematic plan view of one end of the elevated track section and passenger car of the system of FIG. 1.

Referring to FIG. 7, it can be seen that a carriage assembly 160 is provided at both ends of center axle beam 156, which spans between track structure 144 and track structure 146. A standard heavy trailer wheel assembly with dual tires can be used for each carriage assembly 160. However, it is preferable to used solid wheels rather than tires. Hanger apparatus 152 includes a pair of bushing sleeves 161 rotatably connecting hanger apparatus 152 to center axle beam 156. Passenger car 124, hanger 152, and bushings 161 rotate as a unit on center axle beam 156, as the car self levels itself when it traverses the curved track sections and during acceleration and deceleration.

Figure 8:
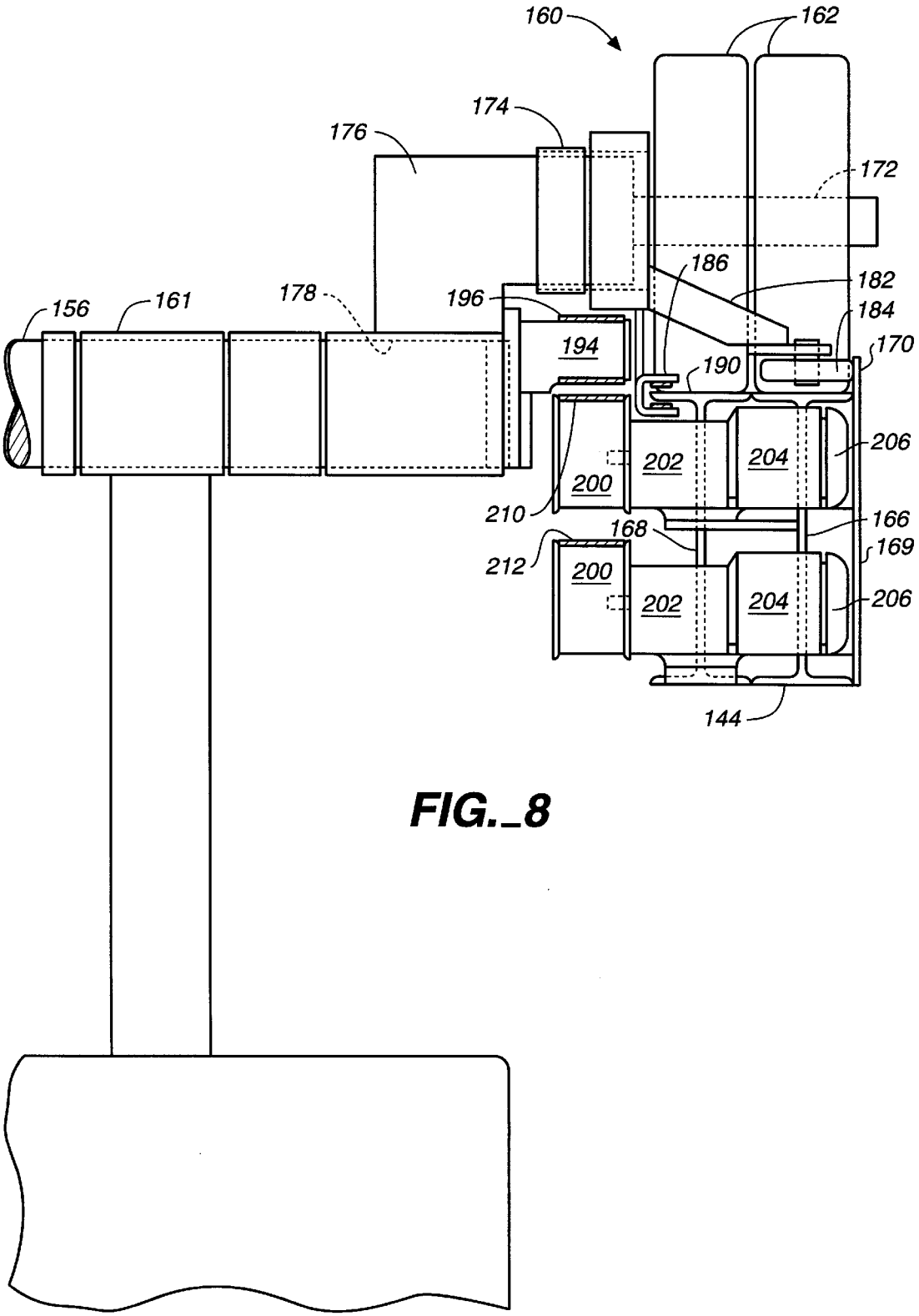
FIG. 8 is an enlarged schematic view of a carriage assembly and drive mechanism of the system of FIG. 1.

Referring to FIG. 8, carriage assembly 160 is shown to include wheels 162 that ride along the upper surface of a pair of joined I-beam members 166, 168, which form the rigid structural component of track structure 144. An outer side panel 169 is mounted at the outer edges of track structure 144, and includes an upwardly extending flange portion 170 that extends above the upper surface of I-beams 166, 168.

Wheels 162 of carriage assembly 160 are rotatably carried on a pair of axles 172 (only one shown). Axles 172 are carried by a common frame structure 174 of carriage 160. Carriage frame 174 includes a leg portion 176 that at its inner end houses a tubular bushing 178 for pivotally carrying center axle beam 156 of hanger apparatus 152. The carriage assembly at the other end of center axle beam 156 includes a similar leg and bushing pivotal support.

An outwardly extending guide arm 182 extends from the outer end of carriage frame 174. Guide arm 182 rotatably carries at its distal end a guide roller 184 that guidingly travels along upwardly extending flange 170. Guide arm 182 and guide roller 184 prevent any undesirable lateral shifting of the passenger car. An emergency brake 186 is mounted to carriage frame 174 via a mounting bracket 188. Emergency brake 186 is provided for brakingly engaging the upper inside flange 190 of I-beam 168 when necessary due to an emergency condition.

A pair of belt drums 194 (only one shown in FIG. 8) are fixedly mounted to the leg portion 176 of carriage frame 174. Belt drums 194 are spaced apart longitudinally, into and out of the page of FIG. 8. Each end of an elongated traction belt 196 is wrapped around a respective belt drum and fixedly secured thereto. The wrapped belt portions and the belt drums form the "grip" for the passenger car, whereat the passenger car attaches to the traction belt. Even though ends of the traction belt are not joined together, but rather are secured to spaced apart drums mounted to the carriage frame, the traction belt is considered to form a continuous loop.

A pair of drive/support/deflection sheaves 200 are spaced from each other, and are each mounted to a reducer 202 and a reversible motor 204. Motors 204 and reducers 202, in turn, are mounted to I-beams 166, 168. A fail-safe brake 206 is provided for each reversible motor 204.

Traction belt 196 includes an upper run 210 and a lower run 212, which runs can be considered upper and lower runs along the horizontal section of the elevated track. Along the vertical sections, runs 210, 212 are more side-by-side than above and below each other. However, herein the terms upper and lower will be used to identify the runs. Each run 210, 212 of traction belt 196 is drivingly engaged by a drive sheave 200, and propelled thereby around the elevated track. As traction belt 196 is propelled around the track, belt drums 194 are carried with the traction belt, which moves carriage 160 and, hence, the hanger assembly 152 and its associated passenger car. The traction belt and the drive sheaves can be said to form the drive assembly of the present invention for propelling the passenger car along the track.

The belt drams 194 are spaced from the sheave associated with upper belt run 210. In this manner, when the passenger car moves past the drive sheaves, Referring to FIG. 9, one end of elevated track structure 144 is shown. The other end is a mirror image. The curved section 132 of track 144 is joined to and supported by a welded return sheave structure cover 220. The frame structure of cover 220 terminates at a wide base and is anchored at ground level in a manner that supports elevated track structure 112. The traction belt 196 diverges as it enters cover 220 and is entrained around a return sheave 222. Return sheave 222 is rotatably carried on a pivotal tension arm 224 pivotally secured at 226 and movable at its other end in the direction of arrow 228. A tensioning screw jack 230 is secured adjacent one end of tensioning arm 224 and its other end is secured to the frame structure of cover 220. Other types of linear actuators can be substituted for screw jack 230. Tensioning screw jack or actuator 230 functions to tension traction belt 196 when the passenger car 124' is at the load/unload point 120 shown in FIG. 9 and the velocity of the car is zero. When the passenger car starts to move, screw jack 230 is set in position to maintain the position of return sheave 222. The return sheave at the other end of traction belt 196 does not have to include a tensioning actuator.

Traction belt 196 is drivingly engaged by a plurality of distributed, side-by-side drive components such as sheaves 200, half of which are located along the lower run 212 of traction belt 196, and half of which are located along the upper ran 210 of traction belt 196, along the curved convex track section 132. While sheaves 200 do not have to be distributed along the entire length of track section 144, it is preferably that the sheaves be distributed along a substantial portion of the length of the track. By substantial portion, it is meant a significant percentage of the length of the guideway, preferably at least five percent. This allows for a reduction in size of the footprint of the system. The runs of traction belt 196 drivingly engage each drive sheave 200 along a portion of each sheave's circumference in a manner that not only drivingly engages and supports the traction belt, but also guides and deflects the traction belt around the curvature of track structure 144. Preferably, approximately 20 drive sheaves are provided at the curved or convex sections of each run of traction belt 196. This provides a total of 160 drive sheaves per passenger car, 80 drive sheaves per track structure 144, 146, with 40 drive sheaves at each end of the respective track structures. With 20 drive sheaves per turn, the traction belt 196 deflects 4.5 degrees per sheave, which greatly increases the resulting drive force transmitted to the traction belt.

While the drive sheaves preferably are positioned along the convex track sections 132, 134, the sheaves could be positioned or distributed over any portion of the length of the track, so long as the drive sheaves are positioned to apply driving forces to the traction belt along a portion of the length of the track. By use of the term convex herein, it is meant that the track curvature is convex relative to the load/unload points. In other words, the track curves in one direction and does not curve back in an opposite direction. For an elevated shuttle system, the track has a generally upwardly convex longitudinal side elevation profile. For a tunneled system, the track has a generally downwardly convex longitudinal side elevation profile. A convex profile allows for passage over the sheaves of the grip of the attachment assembly on the traction belt.

The reversible motors 206 of the drive mechanisms preferably are five horsepower motors with a reducer reduction ratio of 11.5. This can comfortably deliver a tangential force of approximately 318 pounds for a total tangential force of approximately 51,000 pounds. To obtain speeds in excess of 518 feet per minute, the input RPM of the five horsepower motors is increased by adjusting the frequency above 60 hertz. Adjustable frequency drives with regenerating capacity are used. The demand for horsepower and current to the motors does not increase, since the output torque will decrease as the speed increases above nominal 1750 rpm on the horizontal section of the track when there is no need for further passenger car lifting. In addition, sufficient drive sheaves are provided so that when the carriage moves over a sheave and displaces a portion of the traction belt from that sheave, there are enough sheaves in driving engagement with the traction belt to propel the car both horizontally and vertically.

The horizontal track section 114 has a length sufficient to allow the drive assembly to accelerate the passenger car to a speed substantially greater than the average walking speed of a person. Preferably, the passenger car is accelerated to at least five times the average walking speed. With this preferred length, the horizontally extending track section has a length substantially greater than the length of one of the vertical track sections.

Figure 9:
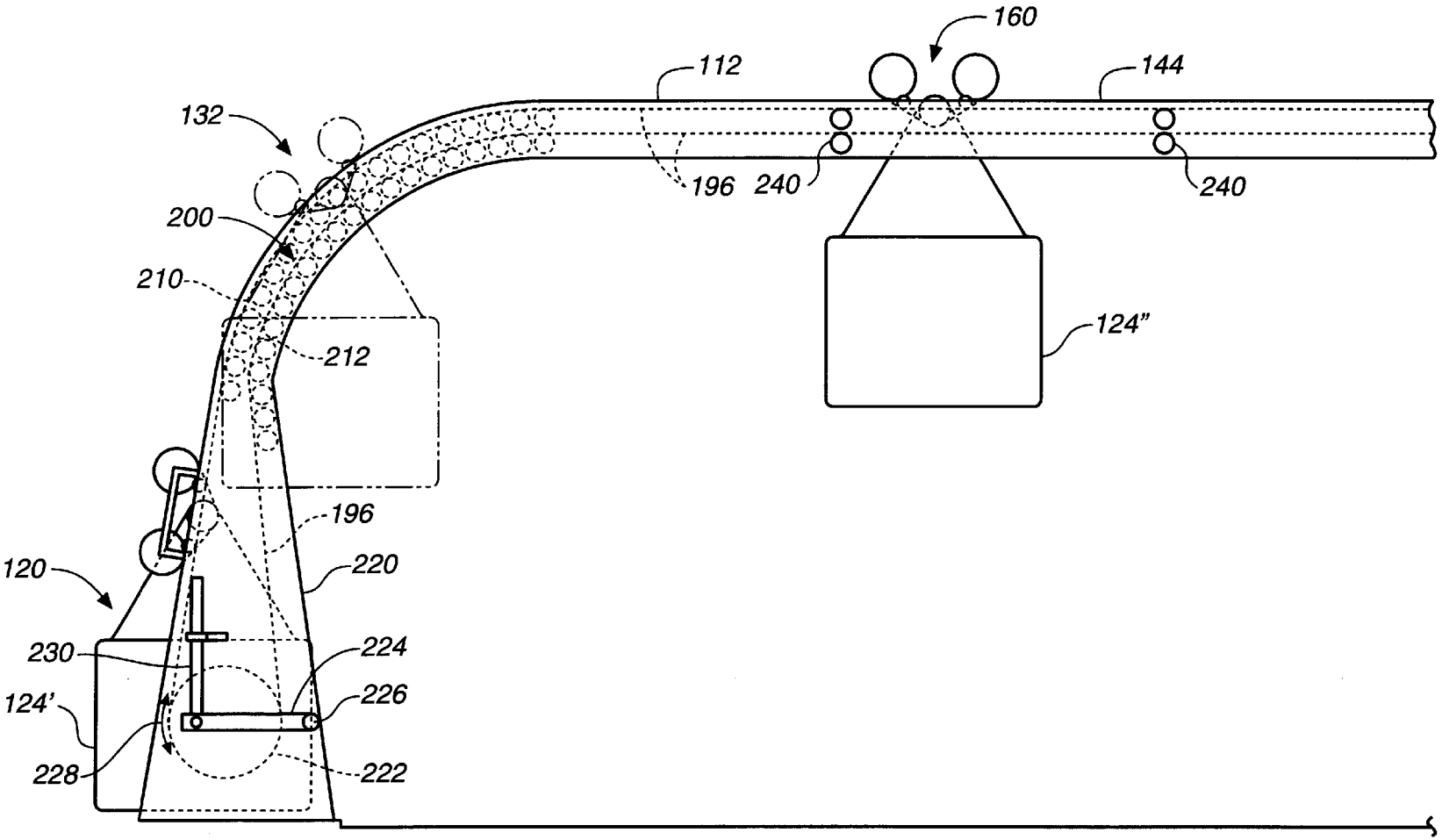
FIG. 9 is an enlarged schematic side elevation view of the track section end of the track of FIG. 1.

Additional drive motors and associated drive sheaves can be provided along other sections of the track, if necessary to raise and accelerate the passenger load. As an example, shown in FIG. 9 are additional pairs of pinch rollers 240, which drivingly engage opposite sides of the traction belt, to provide additional drive force, if necessary.

Preferably, the transitions between curved track sections 132, 134 and the horizontal sections 114 of track structures 144, 146 include a spiral entrance and exit, to reduce the jerk rate of the passenger car movement as it transitions between these track sections. In addition, while horizontal track section 114 is shown in the figures as being substantially horizontal, it could also include slope sections to allow the passenger car to go up and down to cross obstacles.

The shuttle system discussed herein positions the load/unload points proximate the ends of the track section. However, if necessary, the track section could extend beyond the load/unload points. In fact, the shuttle system can have more than two load/unload points. In the preferred embodiment, however, the track extends between load/unload points that are proximate ends of the track. For applications where the shuttle system is to be installed adjacent a roadway or other similar type area where pedestrian traffic is to be limited, the vertical track section can be positioned proximate one of the load/unload points. In this manner, the passenger car is raised, or lowered in a vertical direction to a point permitting horizontal movement of the passenger car beyond the roadway. Such a system provides a compact shuttle system that creates a relatively small foot and sky print.

The single vertical plane system discussed herein with reference to FIGS. 10–18 can also be employed in a subterranean configuration. This configuration essentially requires reversing or inverting the position of the elevated track structure so that the track structure extends downwardly from the load/unload points and then horizontally underground, beneath the area where pedestrian traffic is undesirable. With the overhead system, the passenger car is suspended as would be a conventional cable car and is gravity self-leveled. However, with a tunnel system, it is preferable to track-guide and level the passenger car within a vehicle carriage frame. This will reduce the cross-section of the tunnel, which is always a major cost consideration in tunnel construction.

Figure 10:
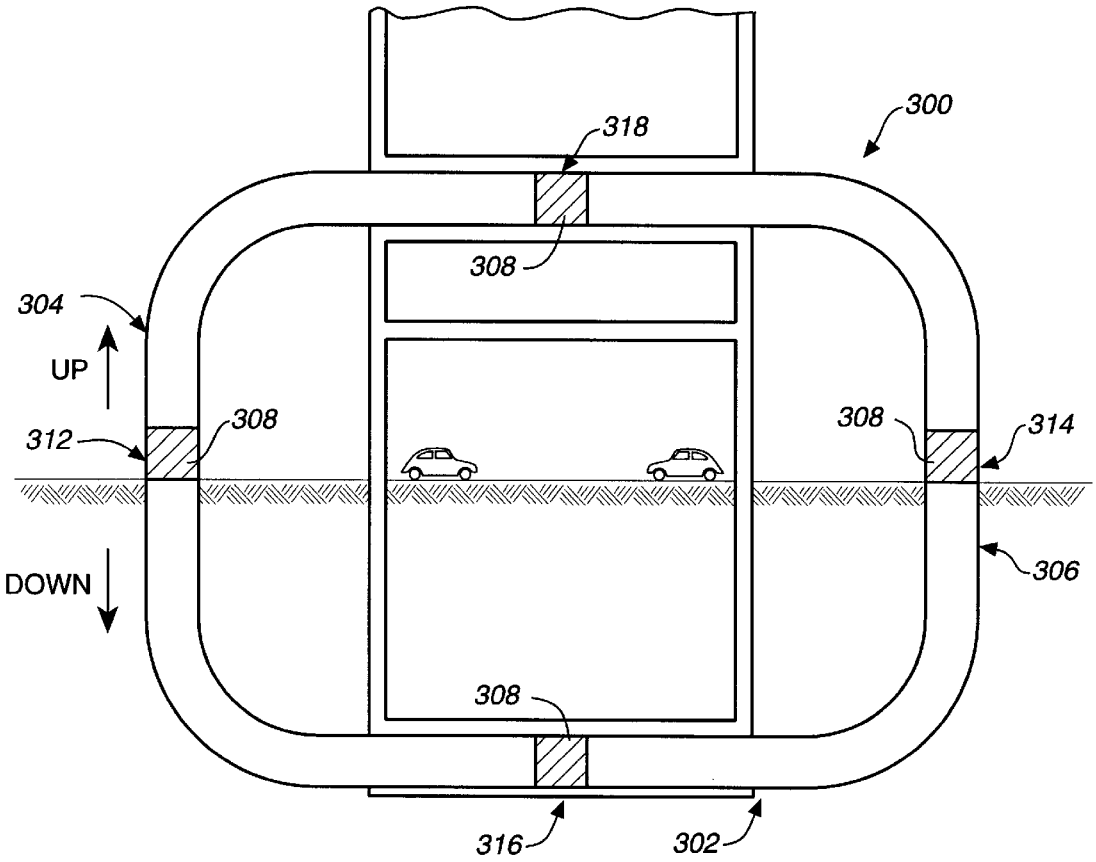
FIG. 10 is a schematic view of an alternative closed loop embodiment of the people mover system of FIG. 1.

Referring to FIG. 10, the single vertical plane system of FIGS. 1–9 can be employed in a looped configuration that includes an elevated track section 300 and a subterranean or lower level track section 302. Vertical sections 304, 306 join with track sections 300, 302 to form a closed looped system. A series of passenger cars 308 are carried by hanger assemblies and carriage assemblies as discussed herein around the closed looped track. In this embodiment, for example, surface level loading and unloading stations 312, 314 can be provided for exit to and entrance from surface level areas, a subterranean or lower level load/unload point 316 can be provided for loading and unloading from a parking garage, and an upper load/unload point 318 can be provided for loading and unloading at a commercial or office level station. In this embodiment, passenger cars 308 move in unison around the closed loop track, each stopping concurrently at one of the load/unload points 312, 314, 316, 318.

Two Plane System

Figure 11:
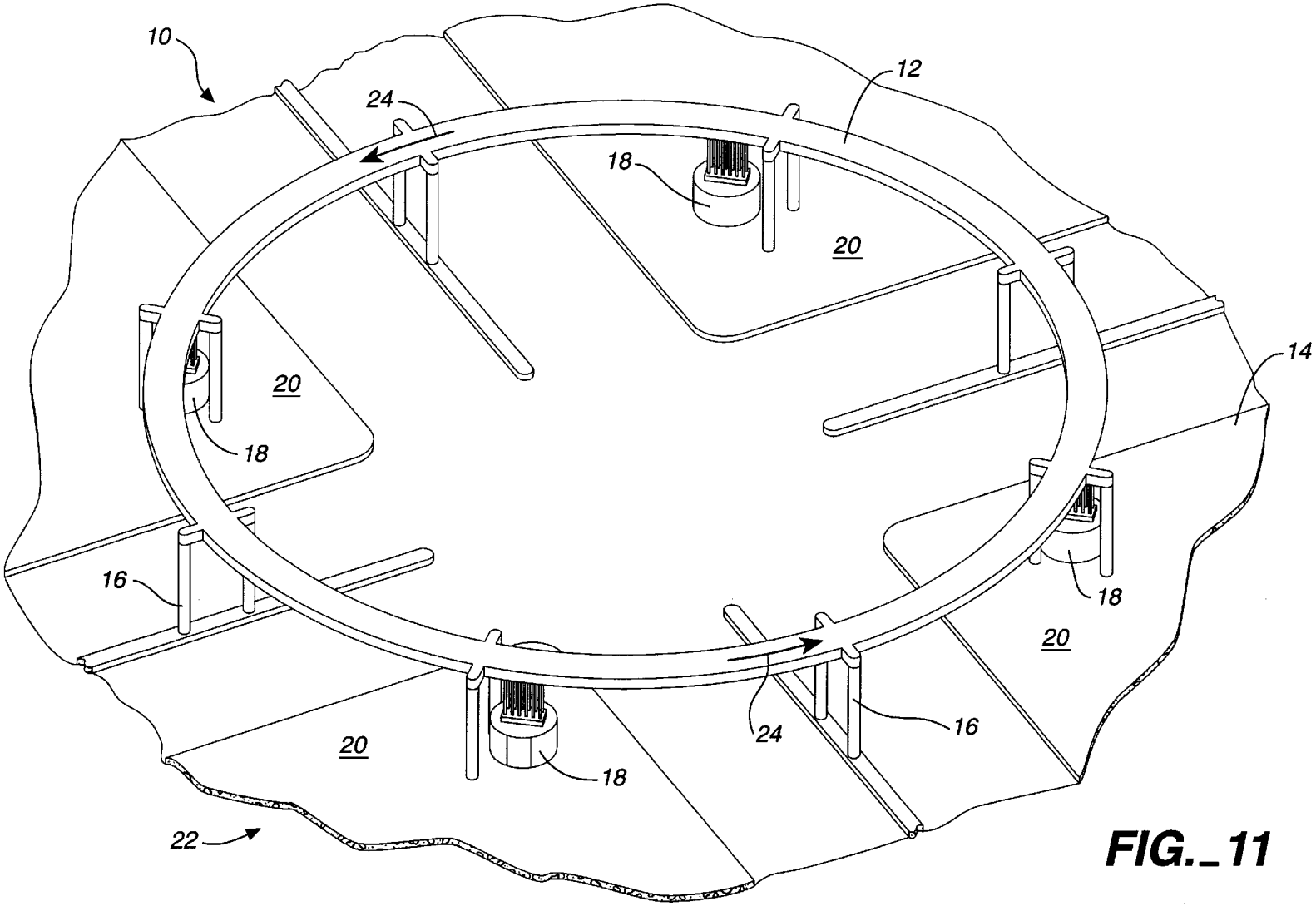
FIG. 11 is a schematic image of an elevated second closed loop embodiment of the people mover system of the present invention.

Referring to FIG. 11, an elevated people mover system 10 is shown to include an elevated track 12 secured at an elevated position above the ground 14 by a series of support towers 16. A set of four passenger cars 18 are provided, one for each intersection corner 20 of an intersection 22. In operation, passenger cars 18 are raised and lowered at each intersection corner 20 to unload and load people at each intersection corner. Once loaded, passenger cars 18 are raised by a lift mechanism discussed later and then passenger cars 18 are moved along elevated track 12, in the direction of arrow 24, to the next intersection corner, where the passenger car is lowered to first unload passengers and then load additional passengers, for travel to the next intersection corner. The passenger cars 18 move around track 12 in a counterclockwise direction, unloading and loading passengers at each intersection corner 20. A passenger desiring to get to the corner diagonally across from him or to the corner to his left must remain in the passenger car until the car travels to the unloading point for that intersection corner. In this manner, it can be seen that vehicular traffic (not shown) at intersection 22 can proceed through the intersection unimpeded by pedestrian traffic. As a result, both vehicles and passengers traverse intersection 20 in an orderly fashion where pedestrians do not have to wait for vehicles to pass and visa versa, vehicles can proceed through the intersection without waiting for pedestrians to pass.

The people mover system 10 is shown as a closed loop system where the passenger cars travel along a closed loop path continuously in a forward direction. However, the embodiment of the present invention shown in FIG. 11 would also work for a point to point system, as well as a subterranean, tunneled system. In any of these types of systems, the passenger cars travel on a fixed elevated or tunneled guideway, moving primarily in a horizontal plane and are either lowered or raised to a pedestrian platform level where passengers can unload and load. The movement of the passenger cars in the vertical and horizontal planes is provided by separate systems, as discussed herein.

Figure 12:
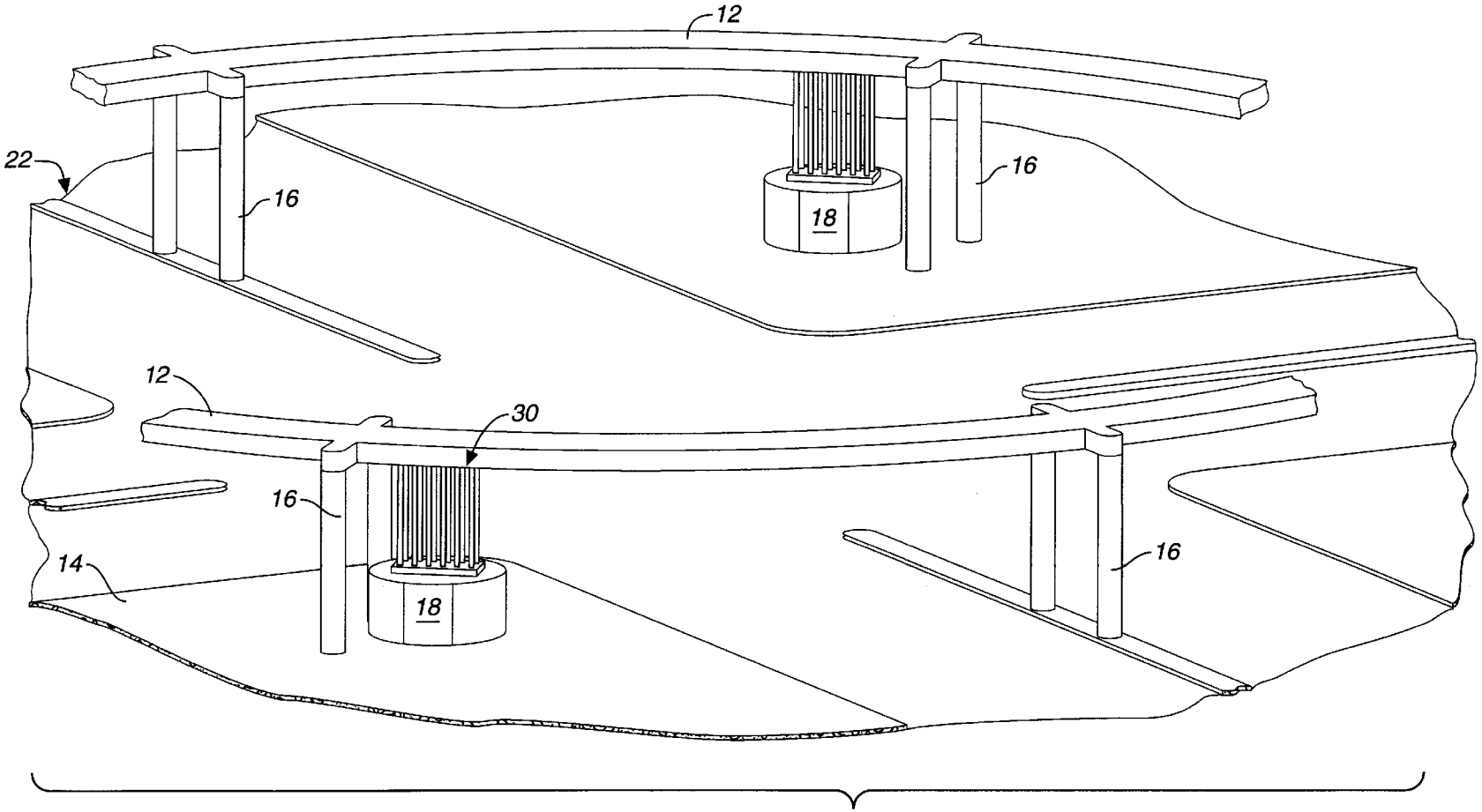
FIG. 12 is an enlarged schematic image of the elevated people mover system of FIG. 11.

Referring to FIG. 12, it can be seen that elevated track 12 is positioned above ground or surface level 14 at a height dictated by the height of support towers 16. Preferably, this height is approximately thirty seven feet. Passenger cars 18 are circular cabins approximately twenty feet in diameter and ten feet in height. The bottom edge of passenger cars 18 is raised to a height of approximately eighteen feet above surface level 14 by means of a lift mechanism that includes a set of lifting belts 30, discussed in more detail later.

Support towers 16 are positioned around intersection 22 at locations dictated by the specific layout of the intersection and not necessarily by any criteria dictated by the present invention. It is only necessary that the spacing between support towers 16 be no greater than necessary to support the elevated track and loaded passenger cars, discussed in more detail herein.

Figure 13:
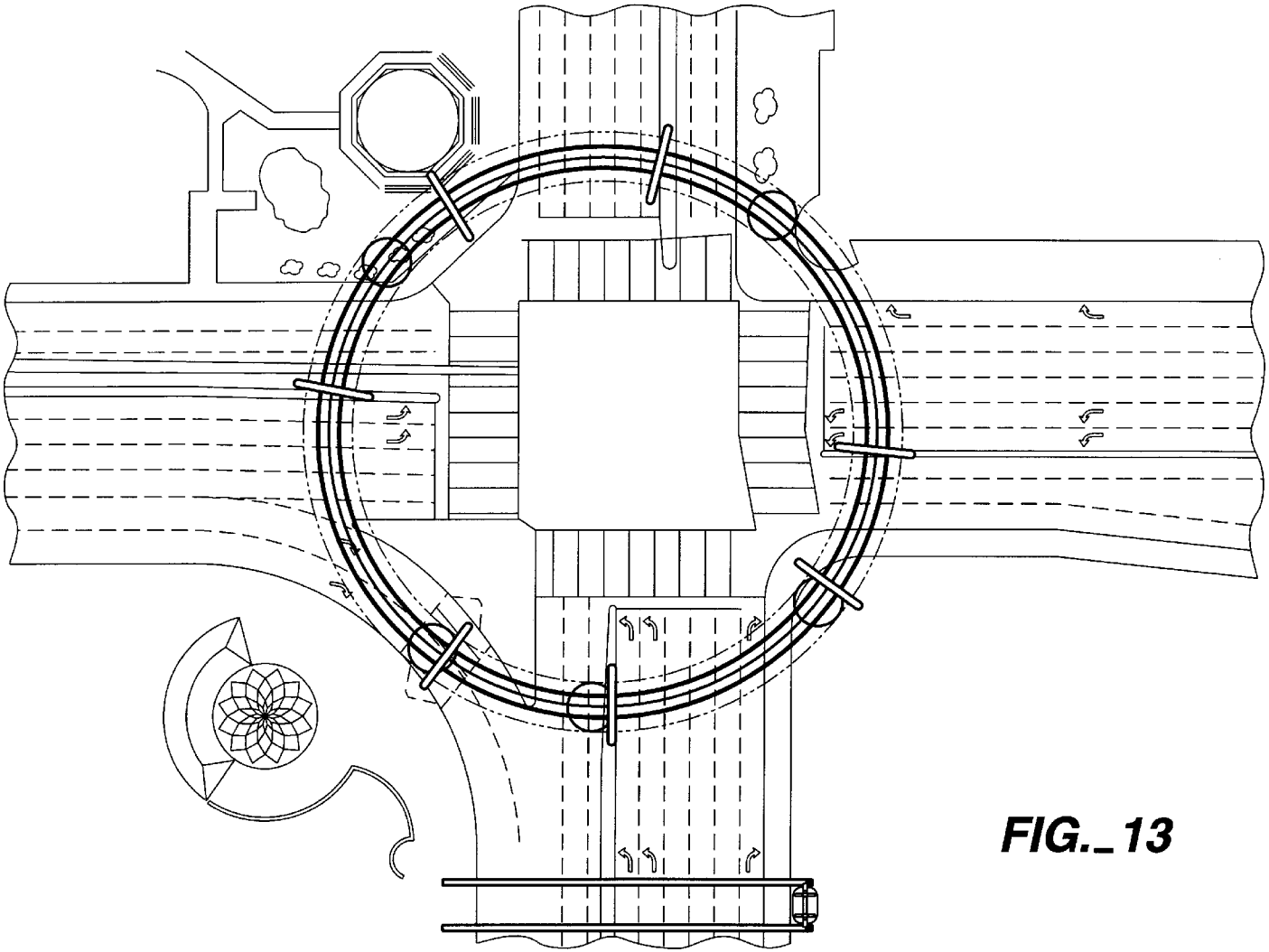
FIG. 13 is a schematic plan view of the elevated people mover system of FIG. 11, shown installed over an intersection.

Referring to FIG. 13, intersection 22 is shown to be similar to the intersection of Las Vegas Boulevard and Flamingo Boulevard that can be found on the Strip in Las Vegas, Nev., U.S.A. The specific layout of this intersection dictates the positioning of support towers 16, with the support towers alternately being spaced one on an intersection corner 20 and the next on a median 32 separating the lanes of the two roads forming intersection 22. Passenger cars 18 are each shown positioned at a load and unload point on a respective intersection corner 20.

It can be seen in FIG. 13 that the spacing between passenger cars 18 is uniform, as is the spacing of the load and unload points of each intersection corner 20. With this symmetrical arrangement, the four passenger cars 18 can be moved in unison around elevated track 12 and then stopped in unison and lowered to surface level at the load and unload points of each intersection corner 20. The vertical movement of the passenger cars as well as the gate closures are synchronized. This symmetrical design greatly simplifies the drive mechanism, as well as its associated controls, for controlling movement of the passenger cars 18 around elevated track 12. It can also be seen in FIG. 13 that elevated track 12 forms nearly a perfect circle. While the present invention is not meant to be limited to a circular people mover system, and can be used for shuttle systems, or for systems that have other shapes such as ovals or generally nonuniform curved paths, the circular system provides many advantages achieved by virtue of its simple design.

Figure 14:
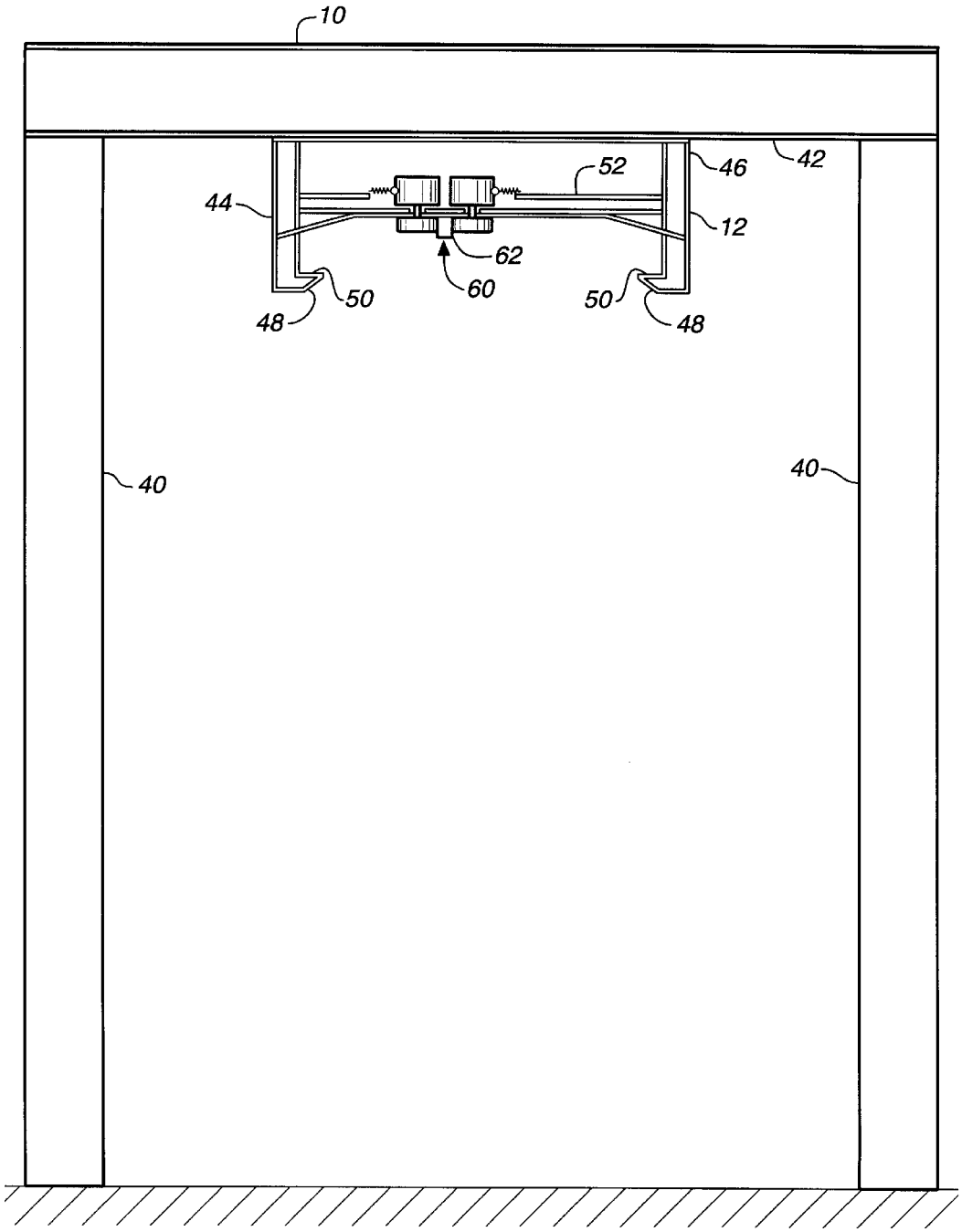
FIG. 14 is a sectional view, taken along the lines B—B of FIG. 15, of the drive mechanism for propelling a passenger car around the elevated track of the people mover system of FIG. 11.

Referring to FIG. 14, the design of a support tower 16 can be seen to include a pair of laterally spaced columns 40 and an overhead frame structure 42. Support columns 40 are approximately thirty-four feet in height and are spaced apart approximately twenty-five feet. Overhead frame structure 42 supports elevated track 12. Elevated track 12 includes a pair of side frame structures 44, 46 each of which includes a lower, inwardly directed flange 48, which forms a carriage support ledge 50. A carriage assembly (not shown) associated with each passenger car rides on ledges 50 between side frame structures 44, 46. Elevated track 12 also includes transverse frame members 52, which extend between side frame structures 44, 46. Additional braces, struts, and other structural framework, not shown or discussed herein, can be included as part of the structure of elevated track 12, if necessary.

A drive mechanism 60 is mounted to and carried by transverse beam 52. Drive mechanism 60, discussed in more detail later, drives a relative rigid circular drive ring 62. Each carriage assembly of the passenger cars is coupled to drive ring 62 and propelled thereby around elevated track 12. It should be noted, however, that drive mechanisms 60 can be carried on the passenger cars rather than on the track structure. With this arrangement, drive ring 62 would be fixedly secured to the track structure, and the drive mechanisms of each car would drivingly engage the fixed drive ring.

Figure 15:
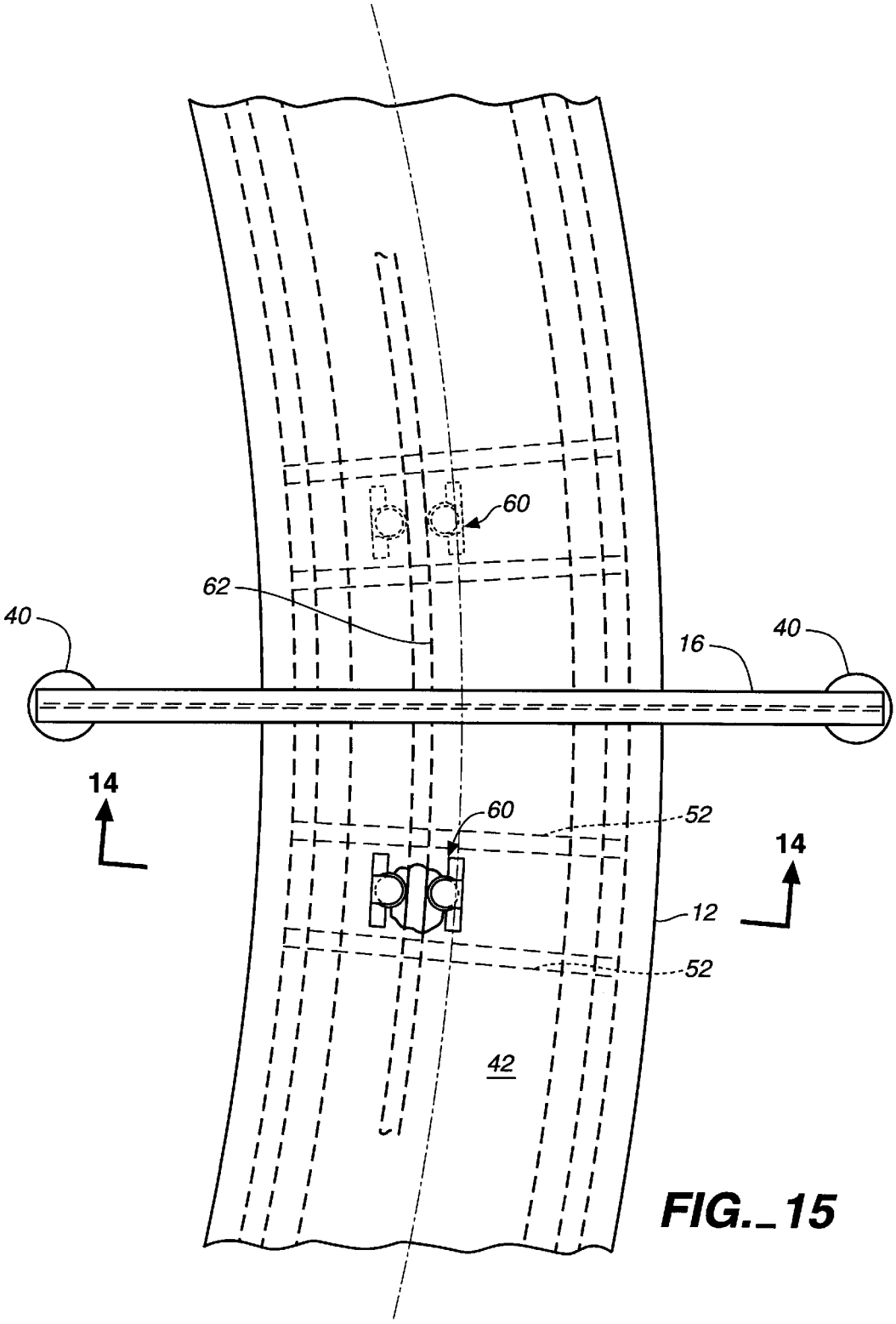
FIG. 15 is a plan view of a support tower and the elevated track, with a portion of the overhead structure of the track cut away to show a drive mechanism, and with the other components of the drive mechanism shown in phantom.

Referring to FIG. 15, a portion of the overhead superstructure 42 of elevated track 12 has been cut away to show the lateral position of a drive mechanism 60. Drive mechanism 60 is shown positioned between a pair of transverse beams 52. Additional longitudinal frame members have not been shown, for clarity, but are included for supporting the components of drive mechanism 60. The drive mechanisms are spaced around elevated track 12 in a uniform manner with the spacing between drive members being dictated by the specific structural design of elevated track 12, as well as by the number of drive mechanisms necessary to propel the passenger cars, when fully loaded, around track 12.

Figure 16:
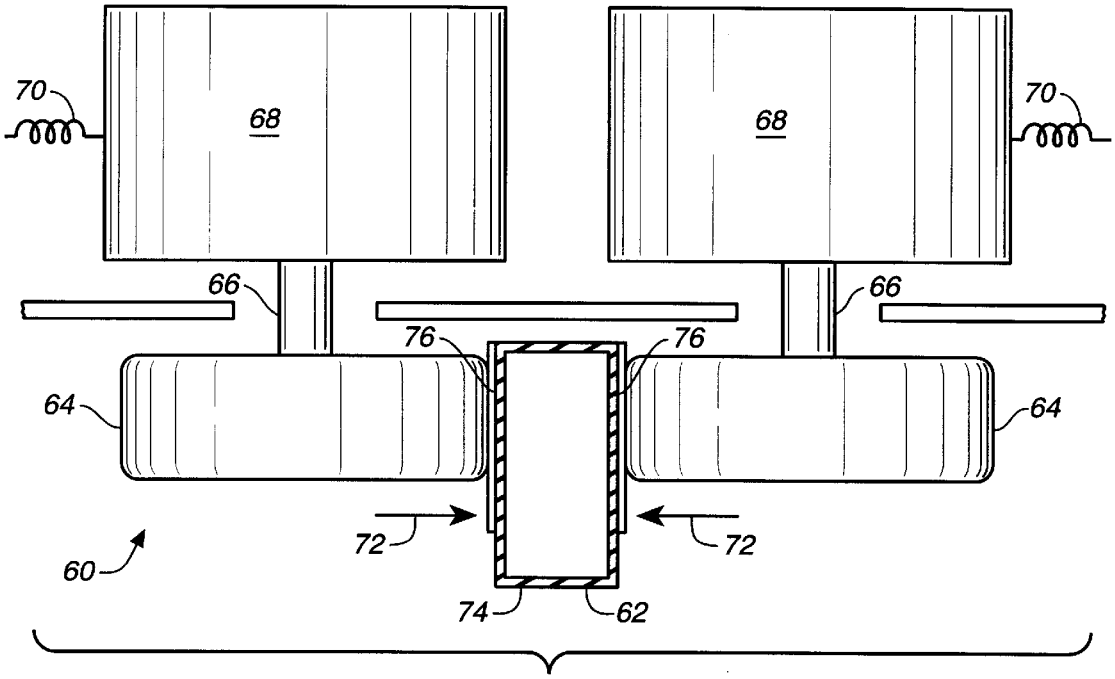
FIG. 16 is an enlarged side elevation view of the drive mechanism of FIG. 15.

Referring to FIG. 16, a drive mechanism 60 is represented schematically to include a pair of pinch rollers 64, each driven on a shaft 66 associated with a drive motor 68. Each motor 68 is biased by a suitable biasing mechanism, such as a coil spring 70, or other type of conventional biasing mechanism that functions to bias motor 68 and pinch rollers 64 inwardly toward one another, as represented by arrows 72. An electric third rail (not shown) is provided for powering motors 68.

Drive ring 62 is captured between pinch rollers 64, which drivingly engage drive ring 62 and propel it in the direction into and out of the page of FIG. 16. Drive ring 62 includes a rectangular tubular member 74 having high friction padding 76 secured on inside and outside facing surfaces of the tubing. A rubber-like material would work satisfactorily for padding 76. Tubular member 74 is relatively rigid and does not require a great deal of flexing for the circular people moving system of the preferred embodiment to work. However, for non circular systems, drive ring 62 may need a great deal of flexibility, and for this type system, a flexible rubber with reinforce steel cables or structural plastic drive belt would be suitable. With a flexible drive ring, suitable guide rollers would be necessary to direct the drive ring around the curved track structure.

Figure 17:
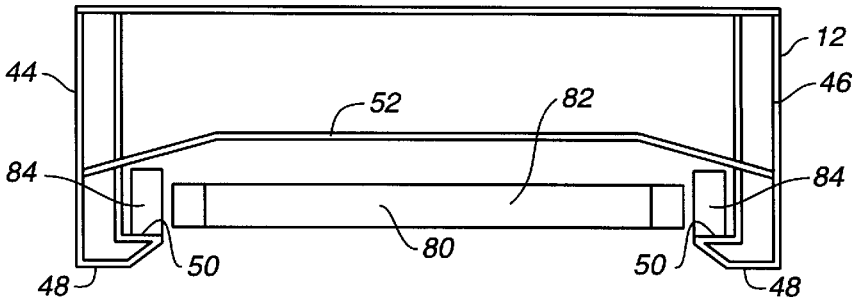
FIG. 17 is a sectional view, taken along the line C—C of FIG. 18, of a carriage assembly that carries a passenger car around the elevated track of the people mover system of FIG. 11.

Referring to FIG. 17, a carriage assembly 80 is shown riding on the ledge surfaces 50 of flanges 48. Carriage assembly 80 includes a frame structure 82 movably carried by a set of rollers 84, which roll on ledge surfaces 50. Frame structure 82 of carriage 80 is secured to the drive ring (discussed and shown in FIG. 16), so that the carriage is propelled around the track with the drive ring. Specifically, as the pinch rollers of the drive mechanism drivingly engage the drive ring and propel it around the elevated track, the rollers 84 of carriages 80 roll along ledges 50.

Figure 18:
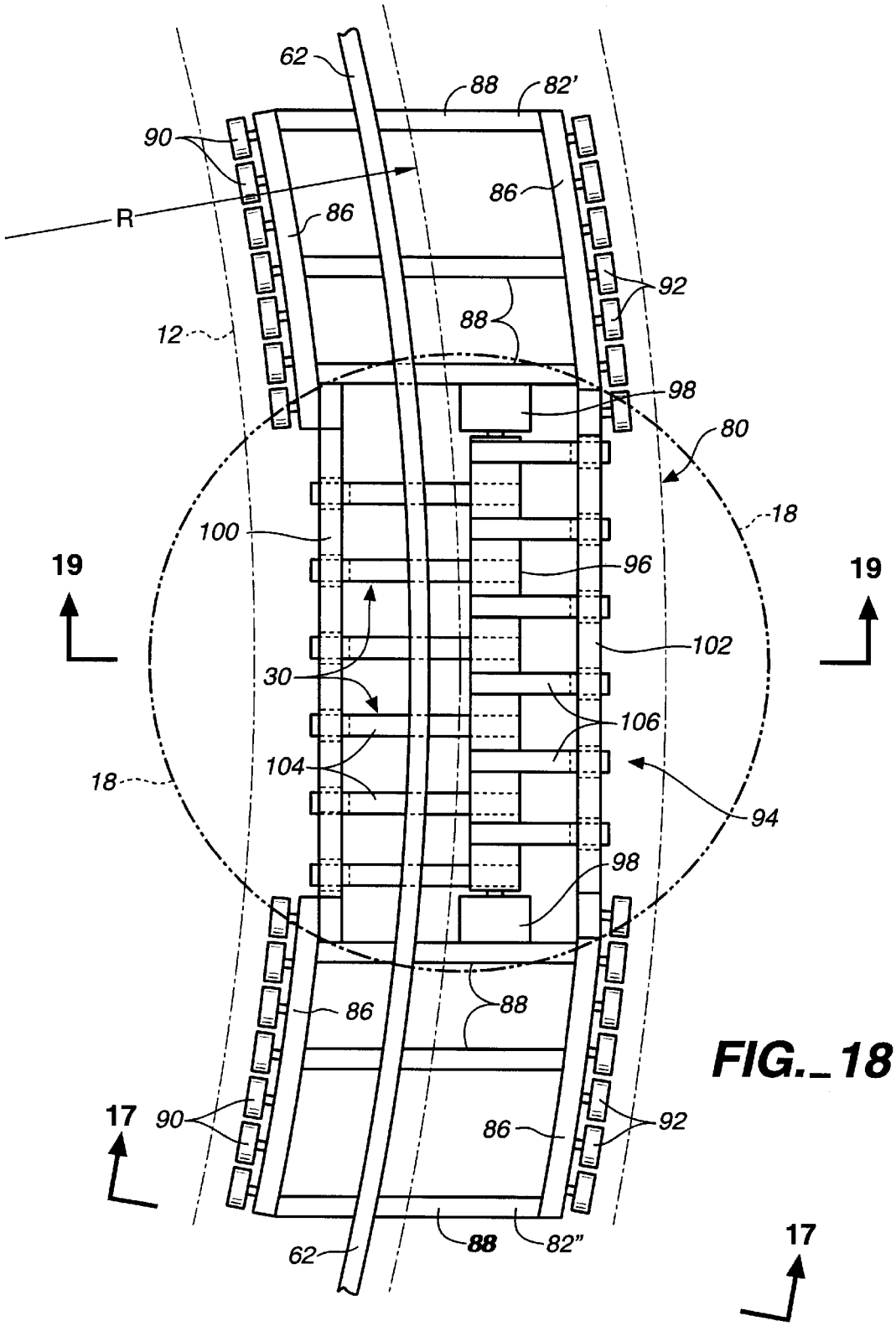
FIG. 18 is a plan view of the carriage assembly of FIG. 17.

Referring to FIG. 18, it can be seen that carriage 80 includes a forward frame structure 82' and a rearward frame structure 82". Each forward and rearward frame structures 82', 82" includes a pair of outer frame members 86 that are joined by a set of three transfer frame members 88. Each forward and rearward frame structure 82', 82" includes a plurality of inside rollers 90 and outside rollers 92, each roller rotatably carried by frame members 86. The axle of each roller 90, 92 is aligned with the radius of curvature R of track 12. In this manner, no independent steering mechanism is necessary for carriage 80.

For non-circular people mover systems, carriages 80 would need to be provided with a steering mechanism that allows the carriages to track along curved portions the track. The design of such a steering mechanism is not considered part of the present invention and should be apparent to those skilled in the art. Reference is made to my co-pending patent application, Ser. No. 08/524,063 and entitled "Semi-Rigid, Fin Based Transportation System," for a discussion of a steerable system.

The forward and rearward frame sections 82', 82" of carriage 80 are joined by a central car lift mechanism 94. Lift mechanism 94 includes an elongated, hollow center drum 96 that is rotatably carried by and drivingly rotated by a motor-reducer-brake assembly 98. Assemblies 98 are secured to the innermost transverse frame member 88 of carriage frame sections 82', 82". The motors of assemblies 98 are reversible, to rotate drum 96 in either direction about its axis, for raising and lowering a passenger car.

An inner, elongated idler roller 100 and an outer elongated idler roller 102 are positioned on either side of center drum 96 and extend between the frame structures 82', 82" of carriage 80. A series of flexible lifting belts, identified collectively be reference numeral 30, include a first set of lifting belts 104 associated with inner idler roller 100 and a second set of drive belts 106 associated with outer idler roller 102. Each set of lifting belt 104, 106 is entrained around and secured to center drum 96 at one end. The lifting belts 104, 106 extend over idler rollers 100, 102 and at their other ends are secured to a passenger car 18.

Figure 19:
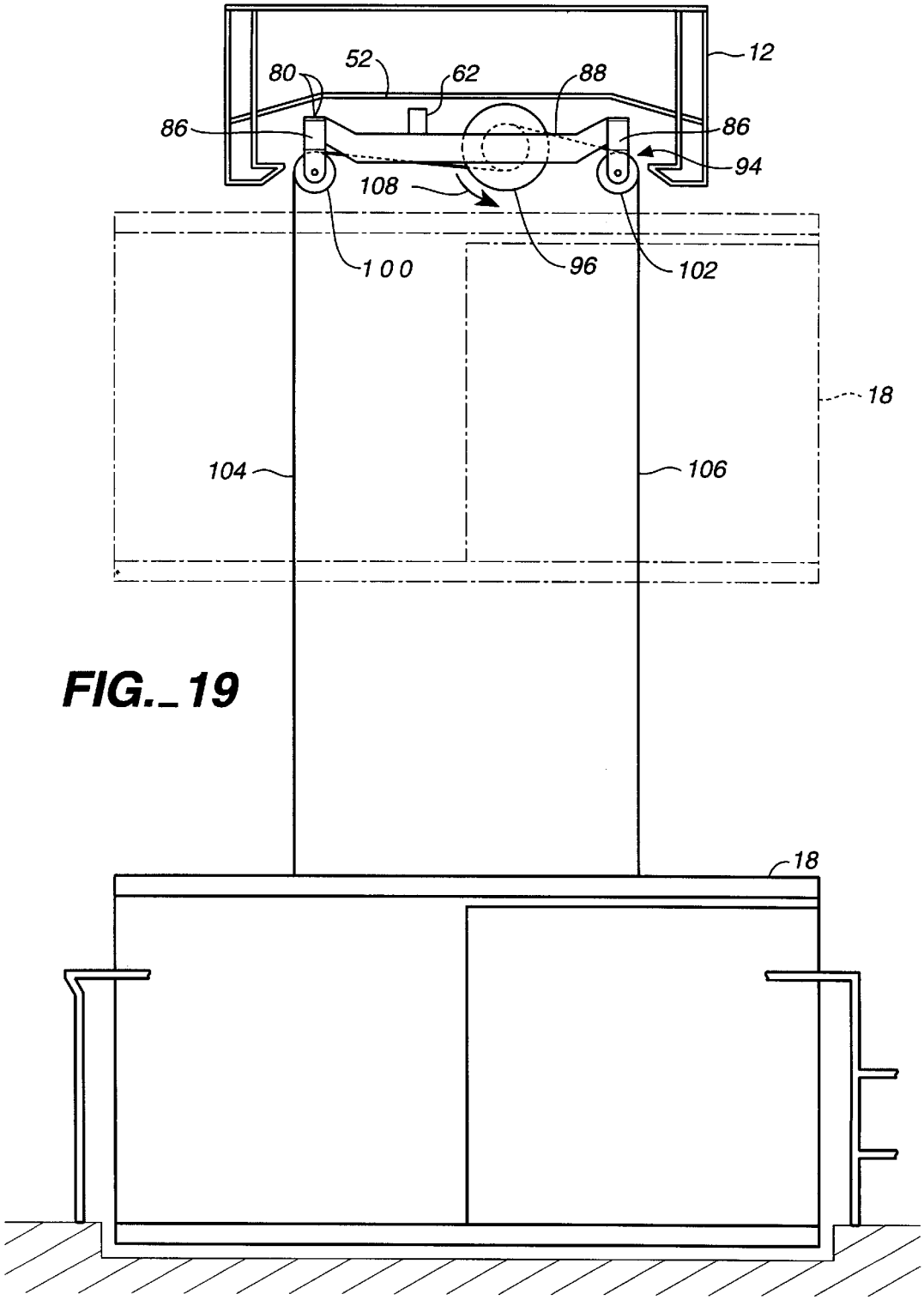
FIG. 19 is a side elevation view of a passenger car shown in a lowered surface level position and shown in phantom in a raised elevated position, and also of the lift mechanism for raising and lowering the passenger car.

The design of lifting mechanism 94 can best be seen in FIG. 19. Transverse frame member 88 is somewhat U-shaped, which lowers its central portion so that drum 96 and drive ring 62 clear the framework structure 52 of elevated track 12. Idler rollers 100, 102 are positioned beneath frame members 86 of carriage 80. Lifting belts 106 extend over idler roller 102 and over and around drum 96. Lifting belts 104 extend around idler roller 100 and underneath and around drum 96. As drum 96 is rotated in the direction of arrow 108, belts 104, 106 wrap around drum 96, which lifts passenger car 18 from its load and unload surface level position shown in solid lines in FIG. 19, to a raised transport position, shown in phantom in FIG. 19. When drum 96 is rotated in the opposite direction, belts 104, 106 are lowered, thus lowering a passenger car.

The choice of elongated flat belt strips for lifting belts 104, 106 was chosen so that the belts have a width dimension that is substantially greater than their depth dimension. The width dimension of the belts aligns with the direction of forward movement of the passenger cars. In other words, the belts are entrained around drum 96 and idler rollers 100, 102 so that their width dimensions align with the axis of the drum, which corresponds with the direction of movement of the carriages and the passenger cars around the elevated track. The inertia of the passenger cars, as they accelerate and decelerate around the track, is carried by the lifting belts not only in the vertical direction but also in a horizontal direction via the width dimension of the belts. In this manner, more passenger car stability and rigidity is obtained in the direction of forward transport of the passenger cars. Preferably, the lifting belts are a flexible rubber-type belt that include reinforcing steel cord belts embedded in the rubber. It has been found that a 0.6 inch thick belt cut into 10 inch or 12 inch wide strips works satisfactorily for the present invention.

The circular design of passenger cars 18 was chosen to facilitate quick unloading and loading of passengers into and out of the cabins of the cars. With circular cabins, doors can be provided that open almost half the circumference of the cars, which greatly facilitates ingress and egress of passengers into and out of the cars. However, other shapes and designs for the cars are suitable for use with the present invention.

The size of drum 96 is chosen so that one revolution of the drum will yield approximately 6 feet of rise of a passenger car. As the lifting belts wrap and unwrap around themselves on the center drum, each successive revolution will have a slightly greater or smaller equivalent lift, depending on whether the passenger car is being raised or lowered.

It is estimated that, with the use of passenger cars capable of holding approximately 210 people per car, a gross vehicle weight of 55,000 pounds is budgeted for each car. This is based on a crush load condition of 1.5 square feet per passenger having an average weight of 154 lbs. A horizontal acceleration of 0.05 g is achievable by a total power for horizontal propulsion of 1,000 horsepower, assuming maximum loads with all cars fully loaded. This is achievable with fifty pairs of pinch rollers each having ten horsepower per motor drive. Vertical acceleration is anticipated to be 0.03 g and is achievable by the provision of a 500 horsepower hoist or winch mechanism for drive assemblies 98.

With the foregoing horsepowers, maximum vertical speed is expected to be approximately 5 to 7 feet per second. Maximum horizontal speed is anticipated to be 15 feet per second. With these speeds, it is expected that a passenger car lowering time will be in the range of 10 seconds, with a corresponding 10 second rise time. Door opening and closing times should be in the range of 6 seconds, with approximately 20 seconds provided for loading and unloading. Travel between stations, largely dependent on the size of the intersection or other application, is expected to be around 24 seconds for the Las Vegas Boulevard-Flamingo intersection. These times provide a total time for one crossing of approximately 70 to 80 seconds, which is less than the average time spent by passengers waiting and walling through this particular intersection. These times can be further reduced by combining the raising and lowering of the vehicle with the last few feet of horizontal movement of the vehicle prior to stopping, as well as the first few feet of horizontal movement as the passenger car accelerates to the next intersection. With the design of the present invention, a practical capacity of 6,000 to 8,000 passengers can be achieved per hour through the intersection.

Both the closed loop system and the shuttle system include a separate carriage assembly for carrying the passenger car. However, it may be possible to integrate the carriage assembly into the passenger car structure or otherwise directly couple the passenger car to the drive belt. The separate carriage assembly disclosed herein functions to guide the passenger car as well as carry the passenger car while allowing the passenger car to pivot. These functions need to be performed, whether by a separate carriage assembly or by an integrated portion of the passenger car. Thus, while it is possible to directly couple the passenger car to the drive mechanism, the passenger car must still be supported and guided, and it is for these purposes that a carriage is provided.

The embodiments of the present invention disclosed herein have a common advantage in that they eliminate the need for costly elevators, escalators and traveling walkways or travelators. Whether with the shuttle system of FIGS. 1–10, or the closed loop system of FIGS. 11–19, movement in both the vertical and horizontal planes is achieved either by dual drive mechanisms as in the closed loop system or with a single drive system with the single plane system of the shuttle embodiment.

The embodiments disclosed herein also have the advantage of being relatively compact in size. By distributing the drive mechanisms along the guideway and utilizing a wide traction belt or drive ring, a large traction surface is achieved and the overall space requirements for the drive mechanisms is greatly reduced. This allows the present invention to be installed in a variety of applications, including many retrofit applications.

The embodiments of the present invention disclosed herein also have the advantage of reducing the size and bulk of pedestrian cross walks, either elevated or tunneled, due to the efficient design of the track structure as well the positioning and design of the drive mechanisms. The system of the present invention replaces walkways and their associated heavy structures and complicated people moving machinery with a compact, lighter frame structure and passenger car drive mechanism that quickly and efficiently transports large numbers of persons. The quicker the passenger cars of the present invention operate, the more compact the system becomes, and the lower are the overall installation costs of the system.

As should be apparent from the foregoing description, the present invention provides a people moving system capable of safe, comfortable and efficient movement of people in both horizontal and vertical directions. The system, as disclosed herein, is adaptable to a variety of applications where pedestrian traffic is undesirable or not practical. The system is relatively simple in design and avoids the use of expensive apparatus such as escalators and elevators. As such, the present invention should provide a less expensive, yet efficient system for transporting large numbers of people across busy intersections or the like.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto when read and interpreted according to accepted legal principles such as the doctrine of equivalents and reversal of parts.

What is claimed is:

1. A people mover system comprising:

a guideway extending along a transit path between two load/unload points;

a drive assembly having a traction belt extending along the guideway and a multiplicity distributed drive elements for applying a drive force to the traction belt over a portion of the length of the guideway;

a passenger car;

an attachment assembly securing the passenger car to the traction belt for propulsion of the passenger car along the guideway by the traction belt;

the guideway having a near vertical section formed for guided substantial vertical movement of the passenger car to a vertical position permitting horizontal movement of the passenger car, the guideway having a horizontally extending section of substantial length relative to the vertical section, and the guideway being formed for continuous guided movement of the passenger car between the vertical section and the horizontally extending section; and the attachment assembly being formed to permit the passenger car to remain in a relatively level orientation as the passenger car is propelled along the guideway.

2. The people mover system as defined in claim 1 wherein, the distributed drive elements include a multiplicity of drive components distributed along a substantial length of the guideway.

3. The people mover system as defined in claim 1 wherein, the vertical section and the horizontally extending section are joined along a convex path relative to the two load/unload points, and the distributed drive elements are distributed along the convex path.

4. The people mover system as defined in claim 3 wherein, the distributed drive elements include a multiplicity of drive sheaves, and the drive sheaves are positioned along the convex path in a manner where the traction belt deflects to at least a small degree over a portion of the circumference of the sheaves.

5. The people mover system as defined in claim 1, wherein the traction belt is entrained around return sheaves approximate the two load/unload points, and at a location between the two load/unload points the guideway forms a convex path along which the traction belt moves, and the distributed drive elements are positioned along the convex path.

6. The people mover system as defined in claim 5 wherein, the distributed drive elements include a multiplicity of drive sheaves, and the drive sheaves are positioned along the convex path in a manner where the traction belt deflects to at least a small degree over a portion of the circumference of the sheaves.

7. The people mover system as defined in claim 1 wherein, the guideway includes a track, and the passenger car is formed for rolling support on the track.

8. The people mover system as defined in claim 1 wherein, the drive assembly is formed for acceleration of the passenger car along the horizontally extending section to a speed substantially in excess of a walking speed.

9. The people mover system as defined in claim 1 wherein, the traction belt is supported by roller elements from the track for movement along the track.

10. The people mover system as defined in claim 1 wherein, the near vertical section extends over a vertical distance at least equal to a height dimension of the passenger car.

11. The people mover system as defined in claim 1 wherein, the vertical distance is in an upward direction relative to one of the load/unload points.

12. The people mover system as defined in claim 1 wherein, the vertical distance is in a downward direction relative to one of the load/unload points.

13. The people mover system as defined in claim 1 wherein, the near vertical section has a vertical dimension sufficient to enable the passenger car to clear an obstacle to horizontal movement.

14. The people mover system as defined in claim 1 wherein, the attachment assembly suspends the passenger car from the traction element for self-leveling of the passenger car.

15. The people mover system as defined in claim 1 wherein, the guideway extends from a load/unload point proximate one end thereof to a load/unload point proximate an opposite end thereof.

16. The people mover system as defined in claim 1 wherein, the vertical section is proximate one of the load/unload points.

17. The people mover system as defined in claim 1 wherein, the guideway includes an additional vertical section formed for movement of the passenger car to a vertical position permitting horizontal movement of the passenger car and being connected to the horizontally extending section in a manner permitting continuous guided movement of the passenger car between the additional vertical section and the horizontally extending section.

18. The people mover system as defined in claim 17 wherein, the guideway has a generally convex longitudinal side elevation profile with the first-named vertical section positioned proximate one load/unload point, the additional vertical section positioned proximate a second load/unload point and the horizontally extending section spanning between the load/unload points.

19. The people mover system as defined in claim 1 wherein, the guideway extends transversely over a vehicle roadway with one of the load/unload points positioned on one side of and proximate to the roadway and another of the load/unload points positioned on an opposite side of and proximate to the roadway; and the guideway includes two vertical sections each formed for near vertical movement of the passenger car to an elevation allowing the passenger car to pass over vehicles on the roadway, and the guideway further includes two transition sections connecting the vertical sections to opposite ends of the horizontally extending section for smooth continuous movement of the passenger car between the vertical sections and the horizontally extending section.

20. The people mover system as defined in claim 1 wherein, the guideway has a generally convex longitudinal side elevation profile with the vertical section at one end of the horizontally extending section and an additional vertical section at an opposite end of the horizontally extending section, the two vertical sections joining the horizontally extending section at transition sections that permit continuous guided movement of the passenger car between the vertical and horizontal sections.

21. The people mover system as defined in claim 20 wherein, the horizontally extending section of the guideway extends above ground level.

22. The people mover system as defined in claim 20 wherein, the horizontally extending section of the guideway extends below ground level.

23. The people mover system as defined in claim 1 wherein, the guideway extends transversely over a vehicle roadway with one of the load/unload terminals positioned on one side of and proximate to the roadway and another of the load/unload terminals positioned on an opposite side of and proximate to the roadway; and the guideway includes two vertical sections each formed for near vertical movement of the passenger car to an elevation allowing the passenger car to pass over vehicles on the roadway, and the guideway further includes two transition sections connecting the vertical sections to opposite ends of the horizontally extending section for smooth continuous movement of the passenger car between the vertical sections and the horizontally extending section.

24. The people mover system as defined in claim 1 wherein, the guideway has a generally convex longitudinal side elevation profile with the vertical section at one end of the horizontally extending section and an additional vertical section and additional transition section at an opposite end of the horizontally extending section.

25. The people mover system as defined in claim 24 wherein, the horizontally extending section of the guideway extends above ground level.

26. The people mover system as defined in claim 24 wherein, the horizontally extending section of the guideway extends below ground level.

27. A people mover system comprising:

a guideway extending along a transit path;

a passenger car;

a drive assembly having an endless traction belt mounted for movement along the guideway and formed to accelerate the passenger car to a speed substantially in excess of a walking speed;

an attachment assembly securing the passenger car to the traction belt for propulsion of the passenger car along the guideway by the traction belt;

the guideway having a near vertical section proximate an end thereof formed for guided vertical movement of the passenger car to a vertical position proximate the end permitting the passenger car to pass beyond an obstacle proximate the end, the guideway having a horizontally extending section with a length sufficient for the passenger car to reach a speed substantially in excess of a walking speed, and the vertical section and the horizontally extending section being connected by a transition section for continuous smooth guided movement of the passenger car between the vertical section and the horizontally extending section; and the attachment assembly being formed to permit the passenger car to remain in a relatively level orientation as the passenger car is propelled along the guideway.

28. The people mover system as defined in claim 27 wherein, the guideway includes a track, and the passenger car is formed for rolling support on the track.

29. The people mover system as defined in claim 28 wherein, the traction belt is supported by roller elements from the track for movement along the track.

30. The people mover system as defined in claim 27 wherein, the near vertical section extends over a vertical distance at least equal to a height dimension of the passenger car.

31. The people mover system as defined in claim 30 wherein, the vertical distance is in an upward direction relative to one of the load/unload points.

32. The people mover system as defined in claim 30 wherein, the vertical distance is in a downward direction relative to one of the load/unload points.

33. The people mover system as defined in claim 27 wherein, the near vertical section has a vertical dimension sufficient to enable the passenger car to clear an obstacle to horizontal movement.

34. The people mover system as defined in claim 27 wherein, the attachment assembly suspends the passenger car from the traction element for self-leveling of the passenger car.

35. The people mover system as defined in claim 27 wherein, the guideway extends from a load/unload terminal proximate one end thereof to a load/unload terminal proximate an opposite end thereof.

36. The people mover system as defined in claim 27 wherein, the vertical section is proximate one of the load/unload terminals.

37. The people mover system as defined in claim 27 wherein, the guideway includes an additional vertical section and an additional transition section, the additional vertical section being formed for movement of the passenger car to a vertical position permitting horizontal movement of the passenger car and being connected to the horizontally extending section by the additional transition section.

38. The people mover system as defined in claim 37 wherein, the guideway has a generally convex longitudinal side elevation profile with the first-named vertical section positioned proximate one load/unload terminal, the additional vertical section positioned proximate a second load/unload terminal and the horizontally extending section spanning between the load/unload terminals.

39. The people mover system as defined in claim 27 wherein, the drive assembly elements include a multiplicity of drive components distributed along a substantial length of the guideway and frictionally engaging the traction belt.

40. The people mover system as defined in claim 27 wherein, the vertical section and the horizontally extending section are joined along a convex path relative to the two load/unload points, and the distributed drive elements are distributed along the convex path.

41. The people mover system as defined in claim 40 wherein, the distributed drive elements include a multiplicity of drive sheaves, and the drive sheaves are positioned along the convex path in a manner where the traction belt deflects to at least a small degree over a portion of the circumference of the sheaves, whereby tension in and deflection of the traction belt enhances frictional driving of the belt.

42. The people mover system as defined in claim 27, wherein the traction belt is entrained around return sheaves approximate the two load/unload points, and at a location between the two load/unload points the guideway forms a convex path along which the traction belt moves, and the distributed drive elements are positioned along the convex path and frictionally engage the traction belt.

43. The people mover system as defined in claim 42 wherein, the distributed drive elements include a multiplicity of side-by-side drive sheaves, and the drive sheaves are positioned along the convex path at locations causing tension in the traction belt to deflect the traction belt to at least a small degree over a portion of the circumference of the sheaves.

44. The people mover system as defined in claim 27 wherein, the drive assembly includes at least two guide sheaves and around at least a portion of each sheave the traction belt is entrained, and the attachment assembly being secured to the traction belt in a manner that displaces a section of traction belt from the path of movement of the traction belt, so that the attachment assembly does not contact a guide sheave as the attachment assembly moves past each sheave.

45. The people mover system as defined in claim 44 wherein, the endless traction belt forms an upper run and a lower run, and the attachment assembly is secured to the traction belt along the upper run of the traction belt.

46. The people mover system as defined in claim 44 wherein, the guide sheaves also function as drive sheaves that drivingly engage the traction belt and propel the traction belt along the guideway, the drive sheaves being provided in sufficient quantity and distribution so that when the attachment assembly moves past a drive sheave and displaces a portion of traction belt from driving engagement with that sheave, a sufficient number of the other drive sheaves remain in driving contact with the traction belt to propel the traction belt and the passenger car along the guideway.

47. The people mover system as defined in claim 46 wherein, the endless traction belt forms an upper run and a lower run, and the attachment assembly is secured to the traction belt along the upper run of the traction belt, and the drive sheaves engage the traction belt along the lower run of the traction belt.

48. A people mover system for transporting persons from a first point to a second point and across an area in between the first and second points where pedestrian traffic is to be limited, comprising a rigid track extending from the first point to the second point, either above or below ground, the track including a first substantially vertical section leading to the first point and a second section extending outwardly in a horizontal direction, a passenger car pivotally carried and movable along the track, a drive belt attached to the passenger car and extending along the track for moving the passenger car between the first and second points, and a drive mechanism for drivingly engaging and propelling the drive belt along both the first and second track sections, whereby persons can load into and unload from the passenger car when the car is positioned at the first point, and between the first and second points, the passenger car first travels substantially vertically away from the first point and then travels substantially horizontally across the area between the first and second points.

49. The people mover system of claim 48 wherein, the drive belt forms a continuous loop around the track and is guided and drivingly engaged by a plurality of sheaves aligned along the track.

50. The people mover of system of claim 49 wherein, the rigid track forms a convex section at the junctions of the first and second sections, and the sheaves are positioned along the convex section.

51. The people mover of system of claim 48 wherein, the second horizontally extending section has a length sufficient for the passenger car to reach a speed substantially in excess of a waking speed.

52. The people mover system of claim 48 wherein, the first section extends over a vertical distance at least equal to a height dimension of the passenger car.

53. The people mover system of claim 48 wherein, the first section has a vertical dimension sufficient to enable the passenger car to clear an obstacle to horizontal movement.

54. The people mover system of claim 48, and further comprising a carriage that pivotally carries the passenger car and moves along the track, the carriage being coupled to the drive belt.

55. The people mover system of claim 54, wherein the track includes a pair of track sections laterally on either side of the passenger car, and a pair of carriages are provided, one for each track section, and the passenger car is pivotally carried by both carriage sections as they ride along the track sections, and a drive belt and a drive mechanism is provided for each track section, for propelling the carriages and the passenger car between the first and second points.

56. The people mover system of claim 48, wherein the track includes a pair of track sections on either side of the passenger car, and the passenger car is pivotally carried and movable along the track sections, and a drive belt and a drive mechanism is provided for each track section, for propelling the passenger car between the first and second points.

57. The people mover system of claim 48, wherein a pair of return sheaves are provided at each end of the track, and the drive belt is entrained around the return sheaves.

58. The people mover system of claim 57, wherein one of the return sheaves includes a tensioning device for maintaining tension in the drive belt.

59. The people mover system of claim 48, wherein the drive mechanism includes a plurality of drive sheaves aligned along curved sections of the track provided between the first and second track sections.

60. The people mover system of claim 59, wherein a plurality of drive sheaves are provided along both an upper run and a lower run of the drive belt.

61. The people mover system of claim 48, wherein the vertical track sections extend upwardly from the first and second points a distance sufficient to permit the passenger car to avoid any obstacles t horizontal movement within the area between the first and second points.

62. The people mover system of claim 61, wherein the vertical track sections extend upwardly a distance sufficient to raise the passenger car at least fifteen feet above the ground.

63. The people mover system of claim 48, wherein the drive belt forms a loop with the ends of the drive belt coupled to the passenger car.

64. The people mover system of claim 63, wherein the passenger car includes a carriage that rides along the track and the passenger car is pivotally carried by the carriage, and wherein the ends of the drive belt are coupled to the carriage.

65. The people moving system of claim 64, wherein the carriage includes a pair of belt drums, and the ends of the drive belt are wrapped around and secured to the belt drums.

66. An elevated people mover system, comprising an elevated rigid track extending above an area where pedestrian traffic is to be limited, the track including substantially vertical end sections that terminate at load/unload points, a passenger car movable along the elevated track, between the load/unload points, a drive mechanism coupled to the car for propelling the car along the track, the passenger car being pivotally secured to the drive mechanism, so that the car can self-level itself as it traverses to and from the vertical track sections, and wherein the vertical track sections provide sufficient rise to elevate the passenger car above obstacles in the area where pedestrian traffic is limited, so that the passenger car can shuttle people across the area in a manner permitting non-pedestrian use of the area.

67. The elevated people mover system as defined in claim 66 wherein, the drive mechanism includes a plurality of drive elements distributed along the rigid track.

68. The elevated people mover system as defined in claim 66 wherein, the rigid track includes convex track sections adjacent the vertical track sections that are convex in shape relative to the load/unload points, and the distributed drive elements include drive sheaves positioned along the convex track sections.

69. The elevated people mover system as defined in claim 68 wherein, the drive mechanism includes a traction belt, and the traction belt extends along the convex track sections and over the drive sheaves in a manner where the traction belt deflects at least a small degree over a portion of the circumference of the drive sheaves.

70. The elevated people mover system of claim 66 wherein, the vertical track sections have sufficient height to permit placement of the load/unload points in close proximity to the area where pedestrian traffic is to be limited.

71. The elevated people mover system of claim 66 and further comprising, a carriage adapted to ride along the elevated track, the passenger car being pivotally coupled to the carriage.

72. The elevated people mover system of claim 71, wherein the drive mechanism includes a drive belt that extends along the vertical track sections, the drive belt forming a continuous loop with the ends of the drive belt secured to the carriage.

73. The elevated people mover system of claim 72, wherein the carriage includes a pair of belt drums, and the ends of the drive belt are wrapped around and secured the belt drums.

74. A people mover system, comprising a rigid track extending between two passenger load/unload points and across an area where pedestrian traffic is limited, the track having a section between the two load/unload points that is substantially horizontal, a passenger car movably carried on the track between the two passenger load/unload points, a drive mechanism for propelling the passenger car along the track, the drive mechanism including a plurality of distributed drive elements distributed along the rigid track for distributing driving forces along a substantial section of the rigid track, means for moving the passenger car in a substantially vertical direction as the car approaches both of the load/unload points.

75. The people mover system of claim 74, wherein the horizontal track section extends above ground.

76. The people mover system of claim 74, wherein the drive mechanism includes a drive member that extends along the track and a drive motor for propelling the drive member, the passenger car being coupled to the drive member.

77. The people mover system of claim 74, and further comprising a carriage assembly movable along the track for carrying the passenger car.

78. An elevated street crossing people mover, for carrying people between corner of an intersection, in a manner permitting vehicle traffic to proceed through the intersection unimpeded by pedestrian traffic, comprising:

an elevated closed loop track extending around the intersection and above a surface level load/unload point at each intersection corner, a car for each intersection corner carried and guided by the elevated track, each car having sufficient room to load a multiplicity of persons, a drive ring extending along the track, each car being coupled to the drive ring at spaced intervals along the ring corresponding to the distance between intersection corners, a drive mechanism on the elevated track for propelling the drive ring around the track, and a lift mechanism that travels with each car for raising and lowering a car between an elevated position and a surface level position, whereby each car is lowered by the lift mechanism at each intersection corner to load and unload people, then raised to an elevated position, then conveyed to the next intersection corner, then lowered at the next intersection corner to load and unload people, and so on, in a manner allowing a person to get from any of the intersection corners to any of the other intersection corners without having to cross through vehicle traffic.

79. The elevated street crossing people mover as defined in claim 78 wherein, the drive mechanism includes a plurality of drive elements distributed along a substantial portion of the length of the track.

80. The elevated street crossing people mover as defined in claim 79 wherein, the distributed drive elements comprise drive sheaves that are biased against the drive ring.

81. The elevated street crossing people mover as defined in claim 80 wherein, pairs of drive elements are aligned on opposite sides of the drive ring and are biased inwardly against the drive ring in a manner that pinches the drive ring between the drive elements.

82. The elevated street crossing people mover of claim 78, wherein the spacing between cars is uniform, so that as each car travels between adjacent intersection corners and stops at the next intersection corner the other cars are each positioned over an intersection corner, in position to be lowered to a load/unload point.

83. The elevated street crossing people mover of claim 78, wherein each lift mechanism includes a belt and winch mechanism for raising and lowering a car.

84. The elevated street crossing people mover of claim 83, wherein the belt and winch mechanism includes a plurality of belts adapted to roll up around an elongated drum, one end of each belt being mounted to a car.

85. The elevated street crossing people mover of claim 84, wherein each belt has a width substantially greater than its depth, and the width of the belt generally aligns with the path of travel of the car.

86. The elevated street crossing people mover of claim 78, wherein the lift mechanism is adapted to raise and lower the passenger car in substantially a vertical direction.

87. A people mover system for transporting persons from a first point to a second point, comprising a track extending from the first point to the second point, a carriage movably carried by the track, a passenger car carried by the carriage, a drive mechanism for moving the carriage between the first and second points, and a lift mechanism movable with the carriage for raising and lowering the passenger car between to a surface level position, whereby persons can load into and unload from the passenger car when the car is positioned at a surface level position at the first point, and then can be transported to the second point by first raising or lowering the passenger car, then moving the passenger car across to the second point, and then lowering or raising the passenger car wherein the lift mechanism includes a winch and belt mechanism, including a plurality of belts extending between the winch and the passenger car.

88. The people mover system of claim 87, wherein each of the plurality of belts includes a width dimension that is substantially greater than a depth dimension of the belt, and the belts are aligned so that their width dimension aligns with the direction of movement of the passenger car.

89. The people mover system of claim 87, wherein the drive mechanism includes a drive ring extending around the track, the carriage being coupled to the drive ring, and a plurality of drive rollers that drivingly engaging the drive ring to propel the ring and the carriage along the track.

90. The people mover system of claim 89, wherein the drive rollers include pairs of opposed pinch rollers biased against the drive ring on opposite side thereof.

91. The people mover system of claim 87, wherein the track is elevated above ground.

92. The people mover system of claim 87, wherein the track is lowered beneath ground level.

93. A method of moving a passenger car between two load/unload points, comprising the steps of guiding the passenger car along a guideway extending between the two load/unload points, the guideway having a near vertical section formed for guided substantial vertical movement of the passenger car to a vertical position permitting horizontal movement of the passenger car, the guideway having a horizontally extending section of substantial length relative to the vertical section, and the guideway being formed for continuous guided movement of the passenger car between the vertical section and the horizontal section, driving the passenger car along the guideway by means of a traction belt extending along the guideway by drivingly engaging the traction belt with a plurality of distributed drive elements to propel the traction belt and the passenger car along the guideway, and leveling the passenger car as it travels along the guideway.

94. The method of claim 93 and further comprising the step of tensioning the traction belt by entraining the traction belt around a pair of return sheaves, and adjustably tensioning the traction belt by adjusting the position of one of the return sheaves.

95. The method of claim 93 wherein the step of driving the passenger car includes accelerating the passenger car along the horizontally extending section to a speed substantially in excess of walking speed.

96. The method of claim 93 wherein the step of guiding the passenger car includes moving the passenger car a vertical distance sufficient to permit horizontal movement of the passenger car.

97. The method of claim 96 wherein the passenger car moves a vertical distance sufficient to avoid obstacles to horizontal movement of the passenger car.

98. The method of claim 96 wherein the passenger car moves a vertical distance at least as great as the height of the passenger car.

99. The method of claim 93, wherein the guideway includes a second near vertical section spaced from the first-named near vertical section, so that the passenger car is propelled along a first vertical distance, then is propelled in a horizontally extending direction, and then is propelled in a second vertical distance, as the passenger car moves between the two load/unload points.

100. The method of claim 99, wherein the guideway is positioned proximate a vehicle roadway, and the near vertical sections are positioned proximate opposite sides of the roadway, and the passenger car is loaded and unloaded at a first load/unload point adjacent one side of the roadway, then is carried over the roadway to a second load/unload point.

* * * * *